US007648547B2

(12) United States Patent
Ohno

(10) Patent No.: US 7,648,547 B2
(45) Date of Patent: Jan. 19, 2010

(54) HONEYCOMB FILTER FOR CLARIFYING EXHAUST GAS

(75) Inventor: Kazushige Ohno, Gifu (JP)

(73) Assignee: Ibiden Co., Ltd., Ogaki-shi (JP)

( * ) Notice: Subject to any disclaimer, the term of this patent is extended or adjusted under 35 U.S.C. 154(b) by 360 days.

(21) Appl. No.: 10/510,344

(22) PCT Filed: Apr. 9, 2003

(86) PCT No.: PCT/JP03/04479

§ 371 (c)(1),
(2), (4) Date: Apr. 14, 2005

(87) PCT Pub. No.: WO03/093657

PCT Pub. Date: Nov. 13, 2003

(65) Prior Publication Data

US 2005/0175514 A1 Aug. 11, 2005

(30) Foreign Application Priority Data

Apr. 10, 2002 (JP) ..... 2002-108538

(51) Int. Cl.

| | |
|---|---|
| ***B01D 39/00*** | (2006.01) |
| ***B01D 24/00*** | (2006.01) |
| ***B01D 39/14*** | (2006.01) |
| ***B01D 50/00*** | (2006.01) |
| ***F01N 3/10*** | (2006.01) |
| ***B01D 53/34*** | (2006.01) |

(52) U.S. Cl. ..... 55/523; 55/522; 55/524; 422/170; 422/171; 422/172; 422/173; 422/174; 422/175; 422/176; 422/177; 422/178; 422/179; 422/180; 422/181; 422/182

(58) Field of Classification Search ..... 55/522–524; 422/170–182
See application file for complete search history.

(56) References Cited

U.S. PATENT DOCUMENTS 4,329,162 A * 5/1982 Pitcher, Jr. ..... 55/523

(Continued)

FOREIGN PATENT DOCUMENTS

EP 0 990 777 4/2000

(Continued)

OTHER PUBLICATIONS

U.S. Appl. No. 11/476,929.

(Continued)

*Primary Examiner*—Walter D Griffin
*Assistant Examiner*—Amber Orlando
(74) *Attorney, Agent, or Firm*—Oblon, Spivak, McClelland, Maier & Neustadt, L.L.P.

(57) ABSTRACT

A honeycomb filter for purifying exhaust gases that is free from occurrence of cracks and coming-off of plugs and is superior in durability upon its use. The honeycomb filter includes a columnar body made of porous ceramics, which has a number of through holes placed in parallel with one another in the length direction with wall portion interposed therebetween, designed so that predetermined of the through holes are filled with plugs at one end of the columnar body, while the through holes not filled with the plugs at the one end are filled with plugs at the other end of the columnar body, and part of or the entire wall portion functions as a plug for collecting particles. A bending strength Fα (MPa) of the honeycomb filter and a length L (mm) of the plug in the length direction of the through hole satisfy the relationship of $F\alpha \times L \geqq 30$.

13 Claims, 8 Drawing Sheets

U.S. PATENT DOCUMENTS 4,559,193 A 12/1985 Ogawa et al.
4,857,089 A 8/1989 Kitagawa et al.
5,171,341 A * 12/1992 Merry ..... 55/484
5,259,190 A 11/1993 Bagley et al.
5,720,787 A 2/1998 Kasai et al.
5,725,618 A * 3/1998 Shimoda et al. ..... 55/283
5,750,026 A 5/1998 Gadkaree et al.
5,914,187 A 6/1999 Naruse et al.
5,930,994 A 8/1999 Shimato et al.
6,214,227 B1 * 4/2001 Park et al. ..... 210/510.1
6,261,982 B1 * 7/2001 Takahashi et al. ..... 501/118
6,447,564 B1 9/2002 Ohno et al.
6,565,630 B2 5/2003 Ohno et al.
6,669,751 B1 12/2003 Ohno et al.
6,770,116 B2 8/2004 Kojima
6,984,253 B2 * 1/2006 Ichikawa et al. ..... 55/484
7,427,309 B2 9/2008 Ohno et al.
7,498,544 B2 3/2009 Saijo et al.
2002/0004445 A1 1/2002 Beall et al.
2003/0006518 A1 * 1/2003 Miyakawa et al. ..... 264/42
2004/0031264 A1 2/2004 Kojima
2004/0033175 A1 2/2004 Ohno et al.
2004/0055265 A1 3/2004 Ohno et al.
2004/0161596 A1 8/2004 Taoka et al.
2004/0223892 A1 11/2004 Kojima
2005/0159310 A1 7/2005 Ohno et al.
2005/0175514 A1 8/2005 Ohno
2005/0176581 A1 8/2005 Ohno et al.
2005/0214504 A1 9/2005 Yoshida
2005/0229565 A1 10/2005 Yoshida
2005/0247038 A1 11/2005 Takahashi
2005/0272602 A1 12/2005 Ninomiya
2006/0019061 A1 1/2006 Oshimi
2006/0029897 A1 2/2006 Saijo et al.
2006/0029898 A1 2/2006 Saijo et al.
2006/0043652 A1 3/2006 Saijo et al.
2006/0051556 A1 3/2006 Ohno et al.
2006/0059877 A1 3/2006 Yoshida
2006/0108347 A1 5/2006 Koyama et al.
2006/0118546 A1 6/2006 Saijo
2006/0172113 A1 8/2006 Kunieda
2006/0210765 A1 9/2006 Ohno et al.
2006/0216466 A1 9/2006 Yoshida
2006/0216467 A1 9/2006 Yoshida
2006/0222812 A1 10/2006 Koyama et al.
2006/0225390 A1 10/2006 Yoshida
2006/0228521 A1 10/2006 Ohno et al.
2006/0230732 A1 10/2006 Kunieda
2006/0254231 A1 11/2006 Hayashi et al.
2007/0068128 A1 3/2007 Oshimi et al.
2007/0085233 A1 4/2007 Yamada
2007/0116908 A1 5/2007 Ohno et al.
2007/0128405 A1 6/2007 Sakaguchi et al.
2007/0130897 A1 6/2007 Sakaguchi et al.
2007/0144561 A1 6/2007 Saijo et al.
2007/0148403 A1 6/2007 Yamamura et al.
2007/0152382 A1 7/2007 Yamada et al.
2007/0169453 A1 7/2007 Hayakawa
2007/0175060 A1 8/2007 Idei et al.
2007/0178275 A1 8/2007 Takahashi
2007/0187651 A1 8/2007 Naruse et al.
2007/0190289 A1 8/2007 Fujita
2007/0190350 A1 8/2007 Ohno et al.
2007/0196620 A1 8/2007 Ohno et al.
2007/0199205 A1 8/2007 Hoshino et al.
2007/0199643 A1 8/2007 Kawai et al.
2007/0204580 A1 9/2007 Kunieda
2007/0212517 A1 9/2007 Ohno et al.
2007/0235895 A1 10/2007 Yamamura et al.
2007/0243283 A1 10/2007 Yamamura et al.
2007/0262497 A1 11/2007 Yamamura et al.
2007/0262498 A1 11/2007 Saijo et al.
2007/0277655 A1 12/2007 Kawai et al.
2008/0006971 A1 1/2008 Kawai et al.
2008/0067725 A1 3/2008 Naruse et al.
2008/0083202 A1 4/2008 Kunieda et al.
2008/0084010 A1 4/2008 Naruse et al.
2008/0088072 A1 4/2008 Kobayashi
2008/0106008 A1 5/2008 Kasai et al.
2008/0106009 A1 5/2008 Naruse et al.
2008/0111274 A1 5/2008 Kawai et al.
2008/0115597 A1 5/2008 Ohno et al.
2008/0116200 A1 5/2008 Kawai et al.
2008/0116601 A1 5/2008 Naruse et al.
2008/0120950 A1 5/2008 Ohno et al.
2008/0136053 A1 6/2008 Kuribayashi et al.
2008/0136062 A1 6/2008 Kasai et al.
2008/0150200 A1 6/2008 Tajima
2008/0157445 A1 7/2008 Kawai et al.
2008/0160249 A1 7/2008 Makino
2008/0174039 A1 7/2008 Saijo et al.
2008/0179781 A1 7/2008 Iwata
2008/0190081 A1 8/2008 Oshimi
2008/0190083 A1 8/2008 Oshimi
2008/0197544 A1 8/2008 Saijo et al.
2008/0211127 A1 9/2008 Naruse et al.
2008/0213485 A1 9/2008 Shibata
2008/0236115 A1 10/2008 Sakashita
2008/0236122 A1 10/2008 Ito
2008/0236724 A1 10/2008 Higuchi
2008/0237428 A1 10/2008 Kobayashi et al.
2008/0237942 A1 10/2008 Takamatsu
2008/0241015 A1 10/2008 Kudo et al.
2008/0241444 A1 10/2008 Oshimi
2008/0241466 A1 10/2008 Saito et al.
2008/0251977 A1 10/2008 Naruse et al.
2008/0284067 A1 11/2008 Naruse et al.
2008/0305259 A1 12/2008 Saijo
2008/0318001 A1 12/2008 Sakakibara
2009/0004431 A1 1/2009 Ninomiya
2009/0079111 A1 3/2009 Kasai et al.
2009/0107879 A1 4/2009 Otsuka et al.
2009/0130378 A1 5/2009 Imaeda et al.

FOREIGN PATENT DOCUMENTS

EP 990 777 4/2000
EP 1 142 619 10/2001
JP 59-054683 3/1984
JP 63-185425 8/1988
JP 63-058620 11/1988
JP 7-332064 12/1995
JP 8-232639 9/1996
JP 08 232639 9/1996
JP 8-281034 10/1996
JP 2001-096113 4/2001
JP 2001-097777 4/2001
JP 2001-340718 11/2001
JP 2003-3823 1/2003
WO WO 01/025165 4/2001

OTHER PUBLICATIONS

U.S. Appl. No. 11/496,431.
U.S. Appl. No. 11/513,149.
U.S. Appl. No. 11/518,998.
U.S. Appl. No. 11/600,775.
U.S. Appl. No. 11/600,784.
U.S. Appl. No. 11/225,197.
U.S. Appl. No. 10/518,548, filed Jan. 3, 2005, Takahashi.
U.S. Appl. No. 10/527,531, filed Mar. 11, 2005, Ogyu et al.
U.S. Appl. No. 10/530,561, filed Apr. 7, 2005, Komori et al.
U.S. Appl. No. 11/174,726, filed Jul. 6, 2005, Ohno et al.
U.S. Appl. No. 11/174,483, filed Jul. 6, 2005, Saijo et al.
U.S. Appl. No. 10/502,044, filed Jul. 29, 2004, Taoka et al.

U.S. Appl. No. 10/504,987, filed Aug. 19, 2004, Kojima.
U.S. Appl. No. 10/506,247, filed Sep. 9, 2004, Kudo.
U.S. Appl. No. 10/509,578, filed Sep. 29, 2004, Yamada.
U.S. Appl. No. 10/507,375, filed Sep. 21, 2004, Ohno et al.
U.S. Appl. No. 10/509,688, filed Oct. 12, 2004, Yamada.
U.S. Appl. No. 10/986,227, filed Nov. 12, 2004, Ono et al.
U.S. Appl. No. 10/513,798, filed Nov. 18, 2004, Kunieda et al.
U.S. Appl. No. 10/515,179, filed Nov. 26, 2004, Yamada.
U.S. Appl. No. 10/515,181, filed Nov. 26, 2004, Komori et al.
U.S. Appl. No. 10/514,560, filed Nov. 30, 2004, Ohno et al.
U.S. Appl. No. 10/516,328, filed Dec. 14, 2004, Komori et al.
U.S. Appl. No. 10/518,373, filed Dec. 28, 2004, Ohno et al.
U.S. Appl. No. 11/033,151, filed Jan. 12, 2005, Ohno et al.
U.S. Appl. No. 10/521,592, filed Jan. 18, 2005, Ohno et al.
U.S. Appl. No. 09/926,795.
U.S. Appl. No. 10/671,418, filed Sep. 26, 2003, Ohno et al.
U.S. Appl. No. 10/129,126.
U.S. Appl. No. 10/362,975, filed Oct. 1, 2001, Ohno et al.
U.S. Appl. No. 10/296,027, filed Mar. 20, 2002, Kojima.
U.S. Appl. No. 10/477,741, filed May 31, 2002, Taoka et al.
U.S. Appl. No. 10/490,206, filed Sep. 2, 2004, Hong et al.
U.S. Appl. No. 10/490,205, filed Sep. 9, 2004, Komori et al.
U.S. Appl. No. 10/493,056, filed Aug. 17, 2004, Hong et al.
U.S. Appl. No. 10/502,045, filed Jul. 29, 2004, Kudo et al.
U.S. Appl. No. 10/502,054, filed Jul. 30, 2004, Kudo et al.
U.S. Appl. No. 10/506,438, filed Sep. 2, 2004, Taoka et al.
U.S. Appl. No. 10/508,415, filed Sep. 21, 2004, Shibata.
U.S. Appl. No. 11/760,037.
U.S. Appl. No. 11/683,698.
"Verband Der Keramischen Industrie: Brevier Technische Keramik", Verband Der Keramischen Industrie E.V., ISBN 3-924158-77-0, Table 44 in Chapter 10.9.2.2, 2003, 3 pages (with English Translation).
Verband Der Technischen Keramischen Industrie: "Brevier Technische Keramik" 2003, Verband Der Keramischen Industrie E.V.; ISBN 3-9224158-77-0; Table 40.
Fatigue characteristics of honeycomb ceramics (New ceramics, 1996, No. 7) with Full English Translation.
U.S. Appl. No. 12/363,396, filed Jan. 30, 2009, inventor Sato.
U.S. Appl. No. 12/369,876, filed Feb. 12, 2009, inventor Sato.
U.S. Appl. No. 12/334,226, filed Dec. 12, 2008, inventor Mizuno et al.
U.S. Appl. No. 12/400,389, filed Mar. 9, 2009, inventor Higuchi.
U.S. Appl. No. 12/342,903, filed Dec. 23, 2008, inventor Ohno.
U.S. Appl. No. 12/393,200, filed Feb. 26, 2009, inventor Saijo.
U.S. Appl. No. 12/411,148, filed Mar. 25, 2009, inventor Hiroshima.

* cited by examiner

Cross-sectional view taken along line A-A

HONEYCOMB FILTER FOR CLARIFYING EXHAUST GAS

CROSS REFERENCE TO RELATED APPLICATION

This application claims benefit of priority to Japanese Patent Application No. 2002-108538, filed on Apr. 10, 2002, the contents of which are incorporated by reference herein.

TECHNICAL FIELD

The present invention relates to a honeycomb filter for purifying exhaust gases that is used as a filter for removing particulates and the like contained in exhaust gases discharged from an internal combustion engine such as a diesel engine.

BACKGROUND ART

In recent years, particulates (fine particles) contained in exhaust gases discharged from internal combustion engines of vehicles such as buses, trucks and the like and construction machines have raised serious problems as these particles are harmful to the environment and the human body.

There have been proposed various ceramic filters which allow exhaust gases to pass through porous ceramics and collect particulates in the exhaust gases to purify the exhaust gases.

Conventionally, in the ceramic filter of this type, a number of through holes are placed in parallel with one another in one direction and wall portion that separates the through holes from each other functions as filters.

In other words, each of the through holes formed in the ceramic filter is sealed with a plug at either of ends of its exhaust gas inlet side or outlet side so as to form a so-called checkered pattern; thus, exhaust gases that have entered one through hole are discharged from another through hole after having always passed through partition wall that separates the through holes from each other. Consequently, when the exhaust gases pass through the partition wall, the particulates are captured by the portion of the partition wall to be purified.

As such a purifying process for exhaust gases progresses, particulates are gradually accumulated on the partition wall that separates the through holes of the honeycomb filter from each other to cause clogging and the subsequent interruption in gas permeability.

In order to solve this problem, there has been developed a honeycomb filter of a back-washing system, which, after having collected particulates, forms a gas flow in a direction reversed to the flow-in direction of exhaust gases so as to remove the particulates; however, this system requires a complex structure, and fails to provide a practical system (see JP Kokai Hei 7-332064).

For this reason, the above-mentioned honeycomb filter needs to be regularly subjected to a recycling process in which the particulates that cause clogging are burned and removed by using heating means such as a heater or the like to regenerate the filter.

Here, in the conventional honeycomb filter having the above-mentioned structure, the region capable of purifying the exhaust gases (hereinafter, referred to as a filtration capable region) corresponds to the inner wall of the through hole that is opened on the exhaust gas flow-in side. In order to maintain the filtration capable region as wide as possible in the honeycomb filter and also to keep the back pressure upon collection of particulates at a low level, it is profitable to make the length of a plug in the length direction of the through hole as short as possible.

Moreover, in the case where the porosity of the honeycomb filter is low, the back pressure becomes higher quickly upon collecting the particulates, with the result that the above-mentioned recycling process using the heating means such as a heater or the like needs to be carried out frequently; therefore, an attempt to make the porosity of the honeycomb filter higher has been made conventionally.

In recent years, another technique has been proposed in which, in place of the above-mentioned recycling process of the honeycomb filter using the heating means such as a heater or the like, by allowing the honeycomb filter to support an oxidizing catalyst in its pores, hydrocarbon contained in exhaust gases that flow into the honeycomb filter is made to react with the oxidizing catalyst, then heat generated through this reaction is utilized for the recycling process. In the honeycomb filter that carries out the recycling process in this manner, it is necessary to increase the porosity thereof, because the oxidizing catalyst is supported on the inside of each pore of the honeycomb filter so that the pore becomes more likely to cause clogging due to particulates, and because the oxidizing catalyst needs to be supported as much as possible in order to generate a large amount of heat, or other reasons.

By increasing the porosity of the honeycomb filter in this manner, it becomes possible to prevent the back pressure from becoming higher, to provide a superior particulate collecting property, and also to allow the filter to support a large amount of oxidizing catalyst.

However, the increase in the porosity of the honeycomb filter causes a reduction in the strength of the honeycomb filter itself. For this reason, when an exhaust gas purifying apparatus, to which the honeycomb filter is attached, is installed in an exhaust gas passage of an internal combustion engine such as an engine or the like, and actually used, cracks tend to occur in the partition wall due to an impact caused by a pressure and the like from the exhaust gases.

Moreover, as described above, the plug to be injected into the end of the through hole is formed to have the length in the length direction of the through hole, which is set as short as possible, in order to maintain the filtering capable region as wide as possible; however, the honeycomb filter of this type has a small contact area between the plug and the partition wall, resulting in a reduction in the adhesion strength of the plug to the partition wall (see JP Kokai 2003-3823).

Here, the portion of the partition wall in which the plug is injected on the outlet side of exhaust gases corresponds to a portion that is to have a highest impact from the pressure and the like from the exhaust gases; consequently, in the case of the honeycomb filter having a reduced bending strength due to the above-mentioned increased porosity, the partition wall in which the plug is injected is more likely to cause: occurrence of cracks due to an impact caused by a pressure and the like from the exhaust gases; and the subsequent coming-off of the plug, resulting in degradation in the durability.

SUMMARY OF THE INVENTION

The present invention is made to solve the above-mentioned problems, and its object is to provide a honeycomb filter for purifying exhaust gases that is free from occurrence of cracks and coming-off of plugs and is superior in durability upon its use.

The present invention provides a honeycomb filter for purifying exhaust gases which has a structure in which:

a columnar body made of porous ceramic comprises a number of through holes, the above-mentioned through holes being placed in parallel with one another in the length direction with wall portion interposed therebetween;

predetermined through holes of the above-mentioned through holes are filled with plugs at one end of the above-mentioned columnar body, while the through holes that have not been filled with the above-mentioned plugs at the above-mentioned one end are filled with plugs at the other end of the above-mentioned columnar body; and a part or all of the above-mentioned wall portion functions as a filter for collecting particulates wherein a bending strength Fα (MPa) of the above-mentioned honeycomb filter for purifying exhaust gases and a length L (mm) of the above-mentioned plug in the length direction of the through hole satisfy the relationship of $F\alpha \times L \geqq 30$.

BRIEF DESCRIPTION OF THE DRAWINGS

FIG. 3(*b*) is a cross-sectional view taken along line B-B of FIG. 3(*a*).

| EXPLANATION OF SYMBOLS | |
|---|---|
| 10, 20 | honeycomb filter for purifying exhaust gases |
| 11, 31 | through hole |
| 12, 32 | plug |
| 13 | wall portion |
| 24 | sealing material layer |
| 25 | ceramic block |
| 26 | sealing material layer |

-continued

| EXPLANATION OF SYMBOLS | |
|---|---|
| 30 | porous ceramic member |
| 33 | partition wall |

DETAILED DISCLOSURE OF THE INVENTION

The present invention provides a honeycomb filter for purifying exhaust gases which has a structure in which:

a columnar body made of porous ceramic comprises a number of through holes, the above-mentioned through holes being placed in parallel with one another in the length direction with wall portion interposed therebetween;

predetermined through holes of the above-mentioned through holes are filled with plugs at one end of the above-mentioned columnar body, while the through holes that have not been filled with the above-mentioned plugs at the above-mentioned one end are filled with plugs at the other end of the above-mentioned columnar body; and a part or all of the above-mentioned wall portion functions as a filter for collecting particulates wherein a bending strength Fα (MPa) of the above-mentioned honeycomb filter for purifying exhaust gases and a length L (mm) of the above-mentioned plug in the length direction of the through hole satisfy the relationship of $F\alpha \times L \geqq 30$.

Additionally, in the following description, "the honeycomb filter for purifying exhaust gases of the present invention" is also simply referred to as "the honeycomb filter of the present invention", and "the length of the plug in the length direction of the above-mentioned through hole" is also simply referred to as "the length of the plug".

Figure 1:
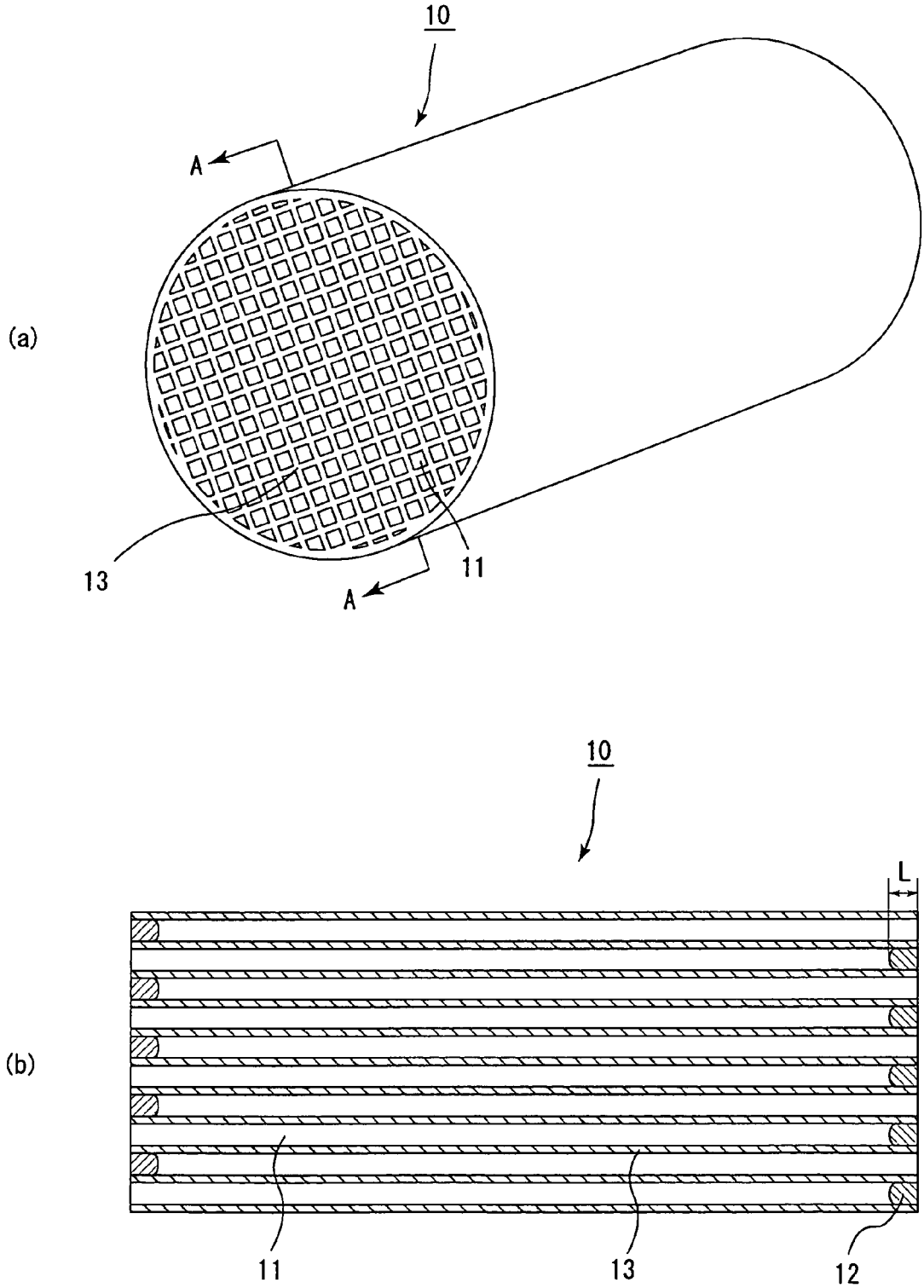
FIG. 1(*a*) is a perspective view that schematically shows one example of a honeycomb filter for purifying exhaust gases of the present invention, and FIG. 1(*b*) is a cross-sectional view taken along line A-A of FIG. 1(*a*).

FIG. 1(*a*) is a perspective view that schematically shows one example of the honeycomb filter of the present invention, and FIG. 1(*b*) is a cross-sectional view taken along line A-A of FIG. 1(*a*).

As shown in FIG. 1(*a*), the honeycomb filter 10 of the present invention is a columnar body made of a single porous ceramic sintered body in which a number of through holes 11 are placed in parallel with one another in the length direction with wall portion 13 interposed therebetween, and all the wall portion 13 is designed to function as filters for collecting particles.

In other words, as shown in FIG. 1(*b*), each of the through holes 11 formed in the honeycomb filter 10 has either of its ends on the inlet-side or outlet-side of exhaust gases sealed with a plug 12; thus, exhaust gases that have entered one of the through holes 11 are allowed to flow out of another through hole 11 after always passing through the wall portion 13 that separates the corresponding through holes 11 from each other.

Consequently, particulates contained in the exhaust gases that have entered the honeycomb filter 10 of the present invention are captured by the wall portion 13 when passing through the wall portion 13, so that the exhaust gases are purified.

The honeycomb filter 10 having the above-mentioned arrangement is disposed in an exhaust gas purifying apparatus and used therein, and the exhaust gas purifying apparatus is installed in an exhaust passage in an internal combustion engine.

It is noted that the exhaust gas purifying apparatus will be described later.

The honeycomb filter 10 of the present invention is designed so that the product of the bending strength Fα (MPa) of the honeycomb filter 10 and the length L (mm) of the plug 12, that is, Fα×L is set to 30 or more.

Figure 3:
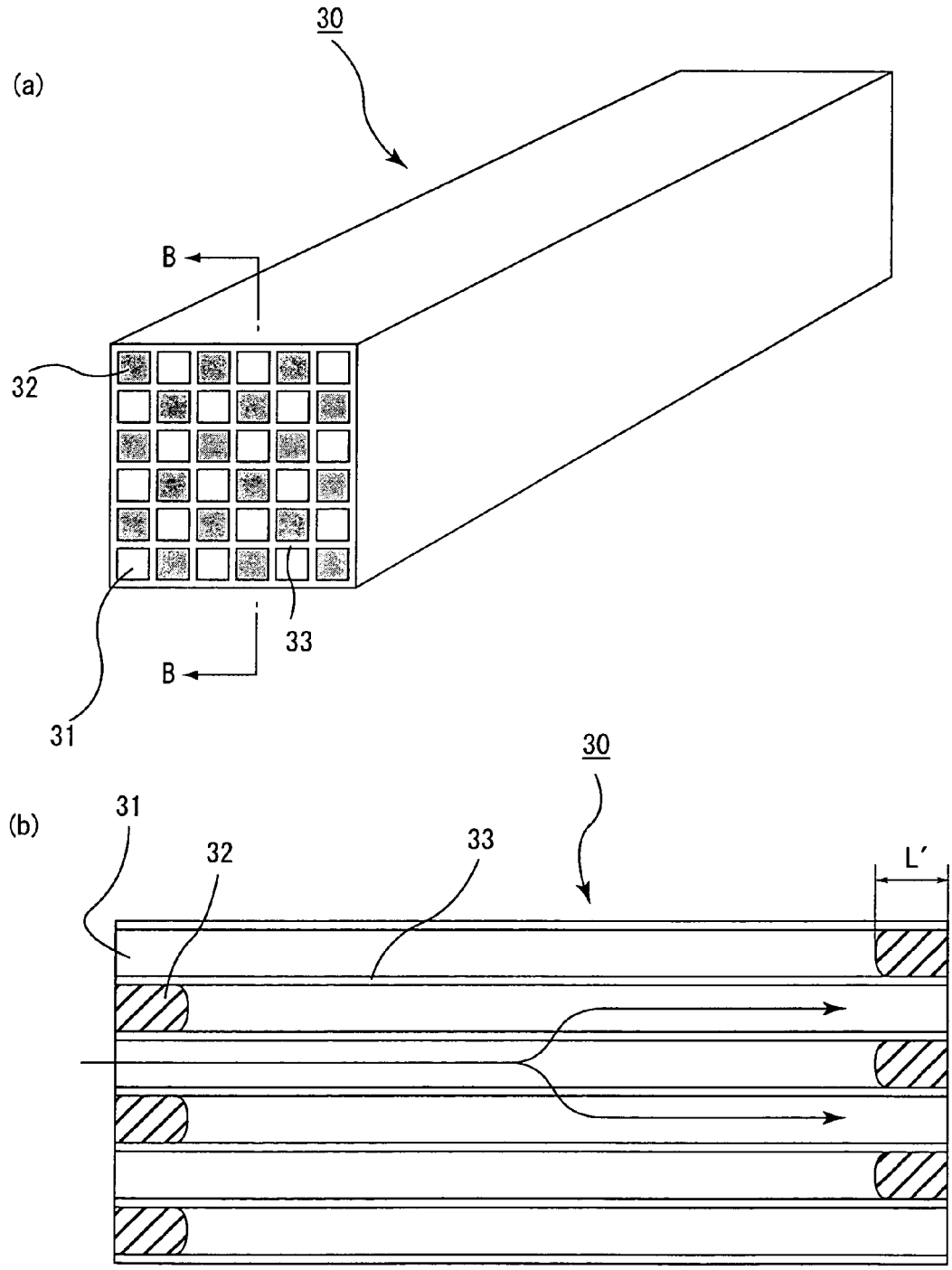
FIG. 3(*a*) is a perspective view that schematically shows a porous ceramic member to be used in the honeycomb filter for purifying exhaust gases of the present invention shown in FIG. 2.

The bending strength Fα of the honeycomb filter 10 of the present invention corresponds to bending strength of the porous ceramic material that constitutes the honeycomb filter 10 of the present invention, and this bending strength Fα is normally measured by the following method: a rectangular columnar sample with a face perpendicular to the length direction of a through hole 11, that has a size of about 34 (mm)×34 (mm), as shown in FIG. 3(*a*), is cut out along the inner walls of the through hole 11, and three-point bending tests were carried out on this sample in accordance with JIS R 1601, and the bending strength is calculated based upon the breaking load, the size of the sample, the secondary moment of the honeycomb cross-section and the span-to-span distance.

In the honeycomb filter 10 of the present invention, the lower limit of Fα×L is set to 30; therefore, in the case where the porosity of the honeycomb filter 10 is increased with the result that the bending strength is lowered, that is, Fα becomes smaller, the length L of the plug 12 is made longer in comparison with a honeycomb filter having a greater bending strength.

Consequently, the contact area between the plug 12 inserted into the end of the through hole 11 and the wall portion 13 becomes greater, making it possible to improve the adhesion strength between these. Therefore, it becomes possible to prevent: occurrence of cracks at the portion of the wall portion 13 filled with the plug 12; and coming-off of the plug 12 due to exhaust gases that flow into the through hole 11.

When the product, Fα×L, is less than 30, the bending strength Fα of the honeycomb filter 10 becomes too small, or the length L of the plug 12 becomes too short.

In the case where the strength Fα is too small, cracks easily occur due to exhaust gases that are flowing into the honeycomb filter of the present invention, failing to use it as the filter for purifying exhaust gases. Further, in the case where the length L is too short, the adhesion strength of the plug injected into the end of the through hole is lowered, causing the plug to come off due to a thermal impact and the like imposed when exhaust gases flow into the honeycomb filter of the present invention.

Moreover, in the honeycomb filter 10 of the present invention, the product, Fα×L, is desirably set to 200 or less. When Fα×L exceeds 200, the bending strength Fα of the honeycomb filter 10 becomes too great, or the length L of the plug 12 becomes too long.

In the case where the bending strength Fα becomes too great, that is, in the case where the honeycomb filter 10 having an extremely great bending strength is manufactured, the porosity of the honeycomb filter 10 becomes too low in some cases, making the back pressure become high immediately, upon collecting particulates; therefore, it is necessary to frequently carry out recycling processes of the honeycomb filter 10. In the case where the length L of the plug is too long, the filtering capable region for exhaust gases in the honeycomb filter 10 of the present invention becomes smaller, also making the back pressure become high immediately, upon collecting particulates; therefore, it is necessary to frequently carry out recycling processes of the honeycomb filter 10.

Moreover, in the case of a honeycomb filter in which Fα×L exceeds 200, the back pressure sometimes rises abruptly in use, causing a destruction of the honeycomb filter and a trouble in an internal combustion engine such as an engine in some cases.

In the honeycomb filter 10 of the present invention, not particularly limited, the magnitude of the bending strength Fα of the honeycomb filter 10 is properly determined depending on the ceramic material to be used and the porosity of the target honeycomb filter 10, and is desirably set in a range from 1 to 60 MPa. When Fα is less than 1 MPa, it is necessary to make the length L of the plug extremely longer so as to satisfy the relationship Fα×L≦30, and this makes the filtering capable region of the honeycomb filter smaller, and tends to make the back pressure immediately higher upon collecting particulates; therefore, it is necessary to frequently carry out the recycling process of the honeycomb filter. Moreover, the honeycomb filter tends to be easily broken by an impact caused by a pressure and the like from exhaust gases, and it becomes difficult to manufacture the honeycomb filter having such a low strength in some cases. In contrast, when the Fα exceeds 60 MPa, the porosity of the honeycomb filter 10 is lowered, resulting in an abrupt increase in the back pressure upon collecting particulates; therefore, it is necessary to frequently carry out the recycling process of the honeycomb filter.

Moreover, in the honeycomb filter 10 of the present invention, not particularly limited, the length L of the plug 12 is desirably set, for example, in a range from 0.5 to 40 mm.

When L is less than 0.5 mm, the contact area between the plug 12 inserted into the through hole 11 of the honeycomb filter 10 and the wall portion 13 of the honeycomb filter 10 becomes smaller, and the adhesion strength therebetween is lowered, resulting in: occurrence of cracks at the portion of the wall portion 13 filled with the plug 12; and coming-off of the plug 12 due to an impact of a pressure and the like from incoming exhaust gases. In contrast, when L exceeds 40 mm, the filtering capable region for exhaust gases in the honeycomb filter 10 becomes too small, resulting in an abrupt increase in the back pressure upon collecting particulates in some cases; therefore, it is necessary to frequently carry out the recycling process of the honeycomb filter 10. Moreover, in the case of a honeycomb filter of this type, the back pressure sometimes rises abruptly in use, sometimes causing a destruction of the honeycomb filter and a trouble in an internal combustion engine such as an engine.

The honeycomb filter 10 of the present invention is made of a porous ceramic material.

The ceramic material is not particularly limited, and examples thereof may include oxide ceramics such as cordierite, alumina, silica, mullite and the like; carbide ceramics such as silicon carbide, zirconium carbide, titanium carbide, tantalum carbide, tungsten carbide and the like; and nitride ceramics such as aluminum nitride, silicon nitride, boron nitride, titanium nitride and the like. Normally, oxide ceramics such as cordierite and the like are utilized. These materials make it possible to carry out the manufacturing process at low costs, have a comparatively small coefficient of thermal expansion and are less likely to cause oxidation upon their use. Further, silicon-containing ceramics made by blending metallic silicon in the above-mentioned ceramics, and ceramics bonded by silicon and silicate compound may be used.

Moreover, the porosity of the honeycomb filter 10 of the present invention is closely related to the strength of the honeycomb filter 10, and varies depending on the strength; therefore, the porosity, which is set so that the strength is located within the above-mentioned range, is normally set in a range from 30 to 80%. When the porosity is less than 30%, the honeycomb filter 10 is more likely to cause a clogging, while the porosity exceeding 80% causes degradation in the strength of the honeycomb filter 10, with the result that it might be easily broken.

Here, the above-mentioned porosity can be measured through known methods, such as a mercury press-in method, Archimedes method and a measuring method using a scanning electronic microscope (SEM).

The average pore diameter of the porous ceramic members 10 is desirably set in a range from 5 to 100 μm. The average pore diameter of less than 5 μm tends to cause clogging of particulates easily. In contrast, the average pore diameter exceeding 100 μm tends to cause particulates to pass through the pores, with the result that the particulates cannot be collected, making the members unable to function as a filter.

Moreover, as shown in FIG. 1(*b*), in the honeycomb filter 10, a number of through holes 11 used for allowing exhaust gases to flow are arranged in parallel with one another in the length direction with wall portion 13 interposed therebetween, and each of the through holes 11 has either of its ends on the inlet-side or outlet-side sealed with a plug 12.

The material to be used for forming the plug 12 is not particularly limited and, for example, the above-mentioned material mainly composed of ceramic is proposed. In particular, the same material as the ceramic material forming the honeycomb filter 10 is desirably used. Thus, it becomes possible to provide the same thermal expansion coefficient as the honeycomb filter, and consequently to prevent generation of cracks due to temperature changes during use and upon recycling processes.

The size of the honeycomb filter 10 is not particularly limited, and it is appropriately determined by taking the size of an exhaust gas passage of the internal combustion engine to be used and the like into consideration.

Moreover, the shape thereof is not particularly limited as long as it is a column shape and, for example, any optional shape such as a cylinderical shape, an elliptical column shape, a rectangular column shape and the like may be used. In general, as shown in FIG. 1, those having a cylinderical shape are often used.

Furthermore, in the honeycomb filter of the present invention, a columnar body is desirably formed by combining a plurality of rectangular columnar porous ceramic members through sealing material layers, each of the rectangular columnar porous ceramic members having a plurality of through holes that are placed in parallel with one another in the length direction with partition wall interposed therebetween. With this arrangement, since the columnar body is divided into the porous ceramic members, it is possible to reduce a thermal stress exerted on the porous ceramic members upon its use, and consequently to make the honeycomb filter of the present invention superior in heat resistance. Moreover, by increasing or reducing the number of porous ceramic members, it is possible to freely adjust the size thereof.

Figure 2:
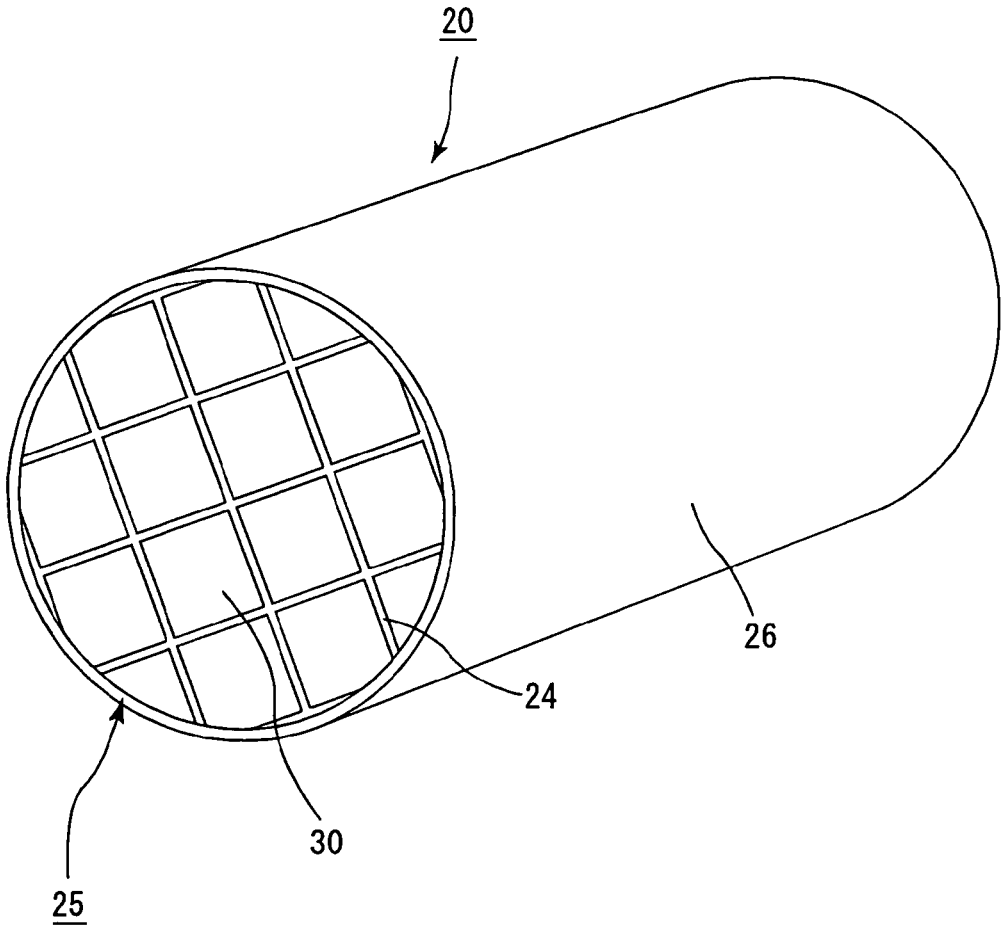
FIG. 2 is a perspective view that schematically shows another example of the honeycomb filter for purifying exhaust gases of the present invention.

FIG. 2 is a perspective view that schematically shows another example of the honeycomb filter of the present invention, FIG. 3(*a*) is a perspective view that schematically shows one example of porous ceramic members that constitute the honeycomb filter shown in FIG. 2, and FIG. 3(*b*) is a cross-sectional view taken along line B-B of FIG. 3(*a*).

As shown in FIG. 2, in a honeycomb filter 20 of the present invention, a plurality of porous ceramic members 30 are combined with one another through sealing material layers 24 to form a ceramic block 25, and a sealing material layer 26 is formed on the circumference of the ceramic block 25. Moreover, as shown in FIG. 3, each of the porous ceramic members 30 has a structure in that a number of through holes 31 are placed in parallel with one another in the length direction so that partition wall 33 that separates the through holes 31 from each other functions as filters.

In other words, as shown in FIG. 3(*b*), each of the through holes 31 formed in the porous ceramic member 30 has either of its ends on the inlet-side or outlet-side of exhaust gases sealed with a plug 32; thus, exhaust gases that have entered one of the through holes 31 are allowed to flow out of another through hole 31 after having always passed through the partition wall 33 that separates the corresponding through holes 31 from each other.

Moreover, the sealing material layer 26, which is formed on the circumference of the ceramic block 25, is provided so as to prevent exhaust gases from leaking through the peripheral portion of each ceramic block 25 when the honeycomb filter 20 is installed in an exhaust passage of an internal combustion engine.

Here, in FIG. 3(*b*), arrows indicate flows of exhaust gases.

The honeycomb filter 20 having the above-mentioned structure is installed in the exhaust passage in an internal combustion engine so that particulates in the exhaust gases discharged from the internal combustion engine are captured by the partition wall 33 when passing through the honeycomb filter 20; thus, the exhaust gases are purified.

Since the honeycomb filter 20 of this type has superior heat resistance and provides easy recycling processes and the like, it has been applied to various large-size vehicles and vehicles with diesel engines.

In the honeycomb filter 20 of the present invention having the above-mentioned structure, when the bending strength thereof is designated as $F\alpha'$, with the length of the plug 32 being designated as $L'$, the bending strength $F\alpha'$ of the honeycomb filter 20 and the length $L'$ of the plug 32 satisfy the following relationship: $F\alpha' \times L' \geqq 30$.

Here, the bending strength $F\alpha'$ of the honeycomb filter 20 of the present invention corresponds to bending strength of the porous ceramic member that constitutes the honeycomb filter 20 of the present invention, and this bending strength $F\alpha'$ is normally measured by carrying out three-point bending tests by the use of a rectangular columnar porous ceramic member 30 in accordance with JIS R 1601, and the bending strength is calculated based upon the breaking load, the size of the sample, the secondary moment of the honeycomb cross-section and the span-to-span distance.

The material for the porous ceramic member 30 is not particularly limited, and the same materials as the above-mentioned ceramic materials may be used. In particular, silicon carbide, which has great heat resistance, superior mechanical properties and great thermal conductivity, is desirably used.

With respect to the porosity and average pore diameter of the porous ceramic member 30, the same porosity and average pore diameter as those of the honeycomb filter 10 of the present invention described by using FIG. 1 may be used.

With respect to the particle size of ceramic particles to be used upon manufacturing the porous ceramic members 30, although not particularly limited, those which are less likely to cause shrinkage in the succeeding firing process are desirably used, and for example, those particles, prepared by combining 100 parts by weight of particles having an average particle size from 0.3 to 50 μm with 5 to 65 parts by weight of particles having an average particle size from 0.1 to 1.0 μm, are desirably used. By mixing ceramic powders having the above-mentioned respective particle sizes at the above-mentioned blending ratio, it is possible to provide a porous ceramic member 30.

In the honeycomb filter 20 of the present invention, a plurality of porous ceramic members 30 of this type are combined with one another through sealing material layers 24 to form a ceramic block 25, and a sealing material layer 26 is also formed on the circumference of the ceramic block 25.

In other words, in the honeycomb filter 20 of the present invention, the sealing material layer is formed between the porous ceramic members 30 as well as on the circumference of the ceramic block 25, and the sealing material layer (sealing material layer 24) formed between the porous ceramic members 30 functions as an adhesive layer for joining the porous ceramic members 30 to one another, while the sealing material layer (sealing material layer 26) formed on the circumference of the ceramic block 25 functions as a sealing member for preventing leak of exhaust gases from the circumference of the ceramic block 25, when the honeycomb filter 20 of the present invention is installed in the exhaust passage of an internal combustion engine.

With respect to the material forming the sealing material layer (sealing material layer 24 and sealing material layer 26) not particularly limited, for example, a material composed of an inorganic binder, an organic binder, inorganic fibers and inorganic particles may be used.

As described above, in the honeycomb filter 20 of the present invention, the sealing material layer is formed between the porous ceramic members 30 as well as on the circumference of the ceramic block 25; and these sealing material layers (sealing material layer 24 and sealing material layer 26) may be made of the same material or different materials. In the case where the same material is used for the sealing material layers, the blending ratio of the material may be the same or different.

Examples of the inorganic binder may include silica sol, alumina sol and the like. Each of these may be used alone or two or more kinds of these may be used in combination. Among the inorganic binders, silica sol is more desirably used.

Examples of the organic binder may include polyvinyl alcohol, methyl cellulose, ethyl cellulose, carboxymethyl cellulose and the like. Each of these may be used alone or two or more kinds of these may be used in combination. Among the organic binders, carboxymethyl cellulose is more desirably used.

Examples of the inorganic fibers may include ceramic fibers such as silica-alumina, mullite, alumina, silica and the like. Each of these may be used alone or two or more kinds of these may be used in combination. Among the inorganic fibers, silica-alumina fibers are more desirably used.

Examples of the inorganic particles may include carbides, nitrides and the like, and specific examples thereof may include inorganic powder or whiskers made of silicon carbide, silicon nitride, boron nitride and the like. Each of these may be used alone, or two or more kinds of these may be used in combination. Among the inorganic particles, silicon carbide having superior thermal conductivity is desirably used.

In the honeycomb filter 20 shown in FIG. 2, the ceramic block 25 is formed into a cylinder-shaped; however, not limited to the cylinder-shaped, the ceramic block of the honeycomb filter of the present invention may have any optional shape such as an elliptical column shape, a rectangular column shape and the like.

Although not particularly limited, the thickness of the sealing material layer 26 formed on the circumference of the ceramic block 25 is desirably set in a range of 0.3 to 1.0 mm. The thickness of less than 0.3 mm tends to cause leak of exhaust gases from the peripheral portion of the ceramic block 25 and, in contrast, the thickness exceeding 1.0 mm tends to cause degradation in economical efficiency, although it can sufficiently prevent leak of exhaust gases.

Moreover, a catalyst is desirably attached to the honeycomb filter of the present invention. When such a catalyst is supported thereon, the honeycomb filter of the present invention functions as a filter capable of collecting particulates in exhaust gases, and also to function as a catalyst-supporting member for purifying CO, HC, $NO_x$ and the like contained in exhaust gases.

The catalyst is not particularly limited as long as it can purify CO, HC, $NO_x$ and the like in exhaust gases, and examples thereof may include noble metals such as platinum, palladium, rhodium and the like. In addition to the noble metals, an element such as an alkali metal (Group 1 in Element Periodic Table), an alkali earth metal (Group 2 in Element Periodic Table), a rare-earth element (Group 3 in Element Periodic Table) and a transition metal element, may be added thereto.

Moreover, upon applying the catalyst onto the honeycomb filter of the present invention, it is preferable to apply the catalyst, after the surface thereof has been preliminarily coated with a catalyst supporting film. This arrangement makes it possible to increase the specific surface area, to increase the degree of dispersion of the catalyst, and consequently to increase the reactive portion of the catalyst. Moreover, since the catalyst supporting film prevents sintering of the catalyst metal, the heat resistance of the catalyst can be improved. In addition, the pressure loss is also lowered.

With respect to the catalyst supporting film, for example, a film made of a material such as alumina, zirconia, titania, silica and the like may be used.

With respect to the method for forming the catalyst supporting film, although not particularly limited, upon forming, for example, a catalyst supporting film made of alumina, a method in which the filter is immersed in a slurry solution prepared by dispersing $\gamma$-$Al_2O_3$ powder in a solvent and a sol-gel method may be used.

Additionally, in the case where the catalyst is applied thereto, the bending strength $F\alpha$ is desirably measured after the application of the catalyst. The above-mentioned relationship, $F\alpha \times L \geqq 30$, corresponds to the condition used for preventing the honeycomb filter from breaking down, when it is installed in an exhaust gas purifying apparatus and used; therefore, it is desirable to carry out measurements in the state where the honeycomb filter is attached to the exhaust gas purifying apparatus.

The honeycomb filter of the present invention in which the above-mentioned catalyst is supported is allowed to function as a gas purifying apparatus in the same manner as the conventionally known DPFs with catalyst (Diesel Particulate Filter). Therefore, in the following description, the detailed description of the case where the honeycomb filter of the present invention also serves as a catalyst-supporting member will not be given.

As described above, in the honeycomb filter of the present invention, the bending strength $F\alpha$ of the honeycomb filter and the length L in the length direction of the through hole of the plug satisfy the relationship of $F\alpha \times L \geqq 30$. In other words, in the honeycomb filter of the present invention, even when the bending strength $F\alpha$ of the honeycomb filter is lowered in an attempt to increase the porosity, the length L in the length direction of the through hole of the plug is made longer so as to set the product $F\alpha \times L$ to 30 or more; therefore, the contact area between the wall portion corresponding to the portion in which the plug is inserted and the plug becomes greater, making it possible to improve the adhesion strength.

Therefore, even when an exhaust gas purifying apparatus in which the honeycomb filter of the present invention is installed is attached to an exhaust gas passage in an internal combustion engine such as an engine or the like with exhaust gases being allowed to flow into the through holes of the honeycomb filter, it is possible to prevent: occurrence of cracks in the portion of the wall in which the plug has been injected due to an impact caused by a pressure and the like of the incoming exhaust gases into the through hole; and the subsequent coming-off of the plug, and consequently to provide a honeycomb filter that is superior in the durability.

Next, description will be given of an example of the manufacturing method for the honeycomb filter of the present invention.

In the case where the honeycomb filter of the present invention has a structure formed by a sintered body as a whole, as shown in FIG. 1, first, an extrusion-molding process is carried out by using a raw material paste mainly composed of ceramics as described above, so that a ceramic molded body, which has a shape corresponding to the honeycomb filter 10 as shown in FIG. 1, is formed.

With respect to the material paste, for example, a material, prepared by adding a binder and a dispersant solution to powder made of the above-mentioned ceramics, is proposed.

The above-mentioned binder is not particularly limited, and examples thereof may include methylcellulose, carboxy methylcellulose, hydroxy ethylcellulose, polyethylene glycol, phenol resins, epoxy resins and the like.

Normally, the blend ratio of the above-mentioned binder is desirably set to about 1 to 10 parts by weight to 100 parts by weight of ceramic powder.

The dispersant solution is not particularly limited, and examples thereof may include an organic solvent such as benzene and the like; alcohol such as methanol and the like; water and the like.

An appropriate amount of the above-mentioned dispersant solution is blended so that the viscosity of the material paste is set in a predetermined range.

These ceramic powder, binder and dispersant solution are mixed by an attritor or the like, and sufficiently kneaded by a kneader or the like, and then extrusion-molded so that the above-mentioned ceramic molded body is formed.

Moreover, a molding auxiliary may be added to the above-mentioned material paste, if necessary.

The molding auxiliary is not particularly limited, and examples thereof may include ethylene glycol, dextrin, fatty acid soap, polyalcohol and the like.

Furthermore, a pore-forming agent such as balloons that are fine hollow spheres composed of oxide-based ceramics, spherical acrylic particles and graphite may be added to the above-mentioned raw material paste, if necessary.

The balloons are not particularly limited, and examples thereof may include alumina balloons, glass micro-balloons, shirasu balloons, fly ash balloons (FA balloons), mullite balloons and the like. In particular, fly ash balloons are more desirably used.

Moreover, with respect to the materials to be used for the raw material paste, the blend ratio thereof and the like, these factors are desirably adjusted so as to set the bending strength $F\alpha$ of the honeycomb filter to be manufactured through the post processes in a range from 1 to 60 MPa. As described in the above-mentioned honeycomb filter of the present invention, the resulting honeycomb filter is less likely to be destructed due to exhaust gases flowing into the through holes, and makes it possible to prevent an abrupt increase in the back pressure during a collecting process of particulates.

Here, the bending strength $F\alpha$ of the honeycomb filter is a value that is mainly determined by the ceramic material to be used and its porosity, and the porosity of the honeycomb filter can be controlled by adjusting the material to be used in the material paste, the blend ratio and the like.

Additionally, the porosity of the honeycomb filter can also be controlled to a certain degree, by adjusting firing conditions and the like of the ceramic molded body.

Next, the above-mentioned molded body is dried by using a dryer, such as a microwave dryer, a hot-air dryer, a dielectric dryer, a decompression dryer, a vacuum dryer, a freeze dryer or the like, to form a ceramic dried body, and predetermined through holes are then filled with plug paste that forms a plug; thereafter, the above-mentioned through holes are subjected to mouth-sealing processes so as to be sealed.

Figure 4:
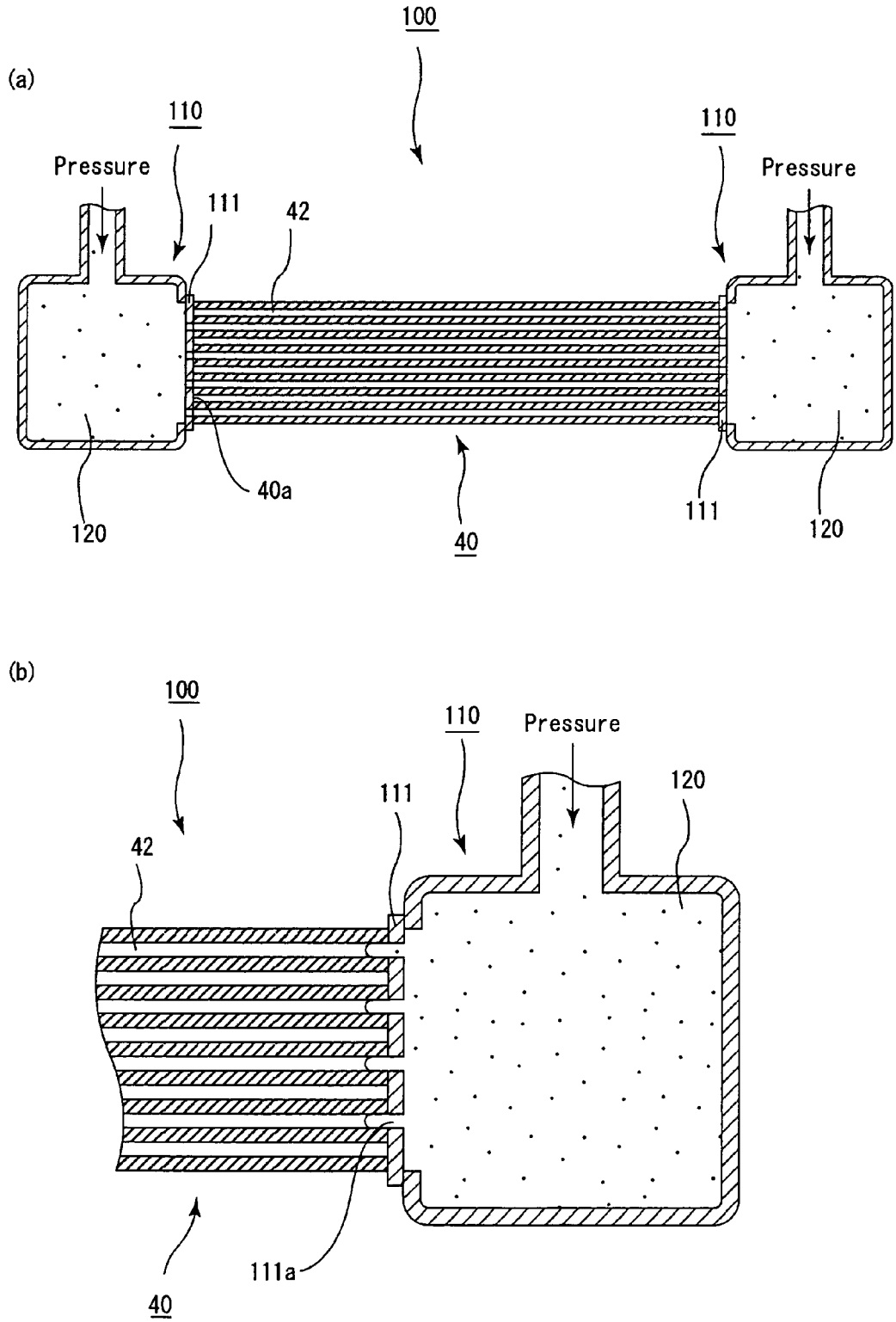
FIG. 4(*a*) is a cross-sectional view that schematically shows one example of a mouth-sealing apparatus to be used upon manufacturing the honeycomb filter for purifying exhaust gases of the present invention, and FIG. 4(*b*) is a partially enlarged cross-sectional view of the mouth-sealing apparatus shown in FIG. 4(*a*).

FIG. 4(*a*) is a cross-sectional view that schematically shows an example of a mouth-sealing apparatus to be used in the above-mentioned mouth-sealing process, and FIG. 4(*b*) is a partially enlarged cross-sectional view that shows one portion thereof.

As shown in FIG. 4, a mouth-sealing apparatus 100 to be used in the mouth-sealing process has a structure in that a pair of tightly-closed plug discharging tanks 110, each of which has a mask 111 that has an opening section 111*a* having a predetermined pattern and is placed on its side face, are filled with plug paste 120 and disposed so that the two side faces, each having the mask 111, are aligned face to face with each other.

In the case where the mouth-sealing process of the ceramic dried body is carried out by using the mouth-sealing apparatus 100 of this type, first, a ceramic dried body 40 is secured between the plug discharging tanks 110 so that the end face 40*a* of the ceramic dried body 40 is made in contact with the mask 111 formed on the side face of each of the plug discharging tanks 110.

At this time, the opening section 111*a* of the mask 111 and the through hole 42 of the ceramic dried body 40 are positioned so that they are aligned face to face with each other.

Next, a predetermined pressure is applied to the plug discharging tank 110 by using, for example, a pump such as a mono-pump, so that the plug paste 120 is discharged from the opening section 111*a* of the mask 111; thus, by injecting the plug paste 120 to the end of the through hole 42 of the ceramic dried body 40, predetermined through holes 42 of the ceramic dried body 40 are filled with the plug paste 120 that forms the plugs.

Here, the mouth-sealing apparatus to be used in the above-mentioned mouth-sealing process is not limited to the above-mentioned mouth-sealing apparatus 100, for example, another system may be used in which an open-type plug discharging tank in which a stirring member is installed is prepared, and by vertically shifting the stirring member, the plug paste, filled in the plug discharging tank, is allowed to flow so that the plug paste is injected.

Here, the distance from the plug paste to the end face of the ceramic dried body is properly adjusted such that the bending strength $F\alpha$ of the honeycomb filter to be manufactured through post processes and the length L of the plug satisfy the relationship of $F\alpha \times L \geqq 30$.

More specifically, the plug paste is desirably injected in a range of 0.5 to 40 mm from the end face of the ceramic dried body.

The plug paste is not particularly limited and, for example, the same material as the above-mentioned raw material paste may be used, and a material, which is prepared by adding a lubricant, a solvent, a dispersant and a binder to the ceramic powder that is used for the material paste, is desirably used.

This material makes it possible to prevent the ceramic particles in the plug paste from precipitating in the middle of the mouth-sealing process.

With respect to the plug paste of this type, the ceramic powder is desirably prepared by adding a small amount of fine powder having a smaller average particle size to coarse powder having a greater average particle size. This arrangement allows the fine powder to bond the ceramic particles to each other. Here, the lower limit of the average particle size of the coarse powder is desirably set to 5 μm, more desirably 10 μm. Moreover, the upper limit of the average particle size of the coarse powder is desirably set to 100 μm, more desirably 50 μm. The average particle size of the above-mentioned fine powder is desirably set to a submicron level.

The materials for the lubricant are not particularly limited, and examples thereof may include polyoxyethylene alkyl ether, polyoxypropylene alkyl ether and the like.

Here, 0.5 to 8 parts by weight of the lubricant of this type is desirably added to 100 parts by weight of the ceramic powder. When the addition is less than 0.5 parts by weight, the precipitation rate of the ceramic particles in the plug paste becomes greater, causing separation immediately. Moreover, since the flow-passage resistance against the plug paste becomes higher, it sometimes becomes difficult to insert the plug paste into the through holes of the ceramic dried body sufficiently. In contrast, when the addition exceeds 8 parts by weight, shrinkage becomes greater at the time of firing the ceramic dried body, with the result that cracks tend to occur.

The above-mentioned polyoxyethylene alkyl ether or polyoxypropylene alkyl ether is prepared by addition-polymerizing ethylene oxide or propylene oxide to alcohol, and has a structure in that an alkyl group is bonded to oxygen at one end of polyoxyethylene (polyoxypropylene). With respect to the above-mentioned alkyl group, although not particularly limited, for example, those groups having 3 to 22 carbon atoms are proposed. The alkyl group may be a straight-chain structure or may have a side-chain structure.

Moreover, the above-mentioned polyoxyethylene alkyl ether and polyoxypropylene alkyl ether may have a structure in that an alkyl group is bonded to a block copolymer consisting of polyoxyethylene and polyoxypropylene.

The solvent is not particularly limited, and example thereof may include diethylene glycol mono-2-ethylhexyl ether and the like.

Here, 5 to 20 parts by weight of the solvent of this type is desirably added to 100 parts by weight of ceramic powder. When the addition thereof is out of this range, it becomes difficult to inject the plug paste into the through holes of the ceramic dried body.

The dispersant is not particularly limited and, an example thereof may include a surfactant made of phosphate. Examples of the phosphate may include phosphate of polyoxyethylene alkyl ether, phosphate of polyoxyethylene alkyl phenyl ether, alkyl phosphate and the like.

Here, 0.1 to 5 parts by weight of the dispersant of this type is desirably added to 100 parts by weight of ceramic powder. The amount of addition of less than 0.1 part by weight tends to fail to evenly disperse ceramic particles in the plug paste, while the amount of addition exceeding 5 parts by weight causes a reduction in the density of the plug paste to cause a greater amount of shrinkage at the time of firing, with the result that cracks tend to occur.

The above-mentioned binder is not particularly limited, and examples thereof may include (meth)acrylate ester-based compounds, such as n-butyl (meth)acrylate, n-pentyl (meth) acrylate and n-hexyl (meth)acrylate.

Here, 1 to 10 parts by weight of the binder of this type is desirably added to 100 parts by weight of ceramic powder. The amount of addition of less than 1 part by weight tends to cause a failure in sufficiently maintaining an adhesion strength between the ceramic particle and the other adhesives. In contrast, the amount of addition exceeding 10 parts by weight causes an excessive increase in the amount of the binder and the subsequent greater amount of shrinkage at the time of firing, with the result that cracks and the like tend to occur.

Then, the ceramic dried body to which the plug paste is injected is subjected to degreasing and firing processes under predetermined conditions, so that a honeycomb filter that is made of porous ceramics and is constituted by a single sintered body as a whole is manufactured.

Here, with respect to degreasing and firing conditions and the like of the ceramic dried body, conditions that are conventionally used for manufacturing a honeycomb filter made of porous ceramics can be applied.

Moreover, in the case where the honeycomb filter of the present invention has a structure, as shown in FIG. 2, in that a plurality of porous ceramic members are combined with one another through sealing material layers, first, an extrusion-molding process is carried out by using the raw material paste mainly composed of ceramics so that a raw formed body having a shape as shown by a porous ceramic member 30 of FIG. 3 is manufactured.

Here, with respect to the above-mentioned raw material paste, the same raw material paste as described in the honeycomb filter constituted by a single sintered body may be used; and with respect to the blend ratio, the same blend ratio as that of the honeycomb filter constituted by a single sintered body or a different blend ratio may be used.

Next, the above-mentioned molded body is dried by using a microwave-dryer or the like to form a dried body, and predetermined through holes are then filled with plug paste that forms a plug; thereafter, the above-mentioned through holes are subjected to mouth-sealing processes so as to be sealed.

Here, with respect to the mouth-sealing processes, the same processes as those used for the honeycomb filter 10 are carried out except that the subject to be filled with the plug paste is different.

Next, the above-mentioned dried body that has been subjected to the mouth-sealing processes is subjected to degreasing and firing processes under predetermined conditions, so that a porous ceramic member having a structure in that a plurality of through holes are placed in parallel with one another in the length direction with partition wall interposed therebetween is manufactured.

Here, with respect to the degreasing and firing conditions and the like of the above-mentioned raw formed body, the same conditions as those conventionally used for manufacturing a honeycomb filter in which a plurality of porous ceramic members are combined with one another through sealing material layers may be applied.

Figure 5:
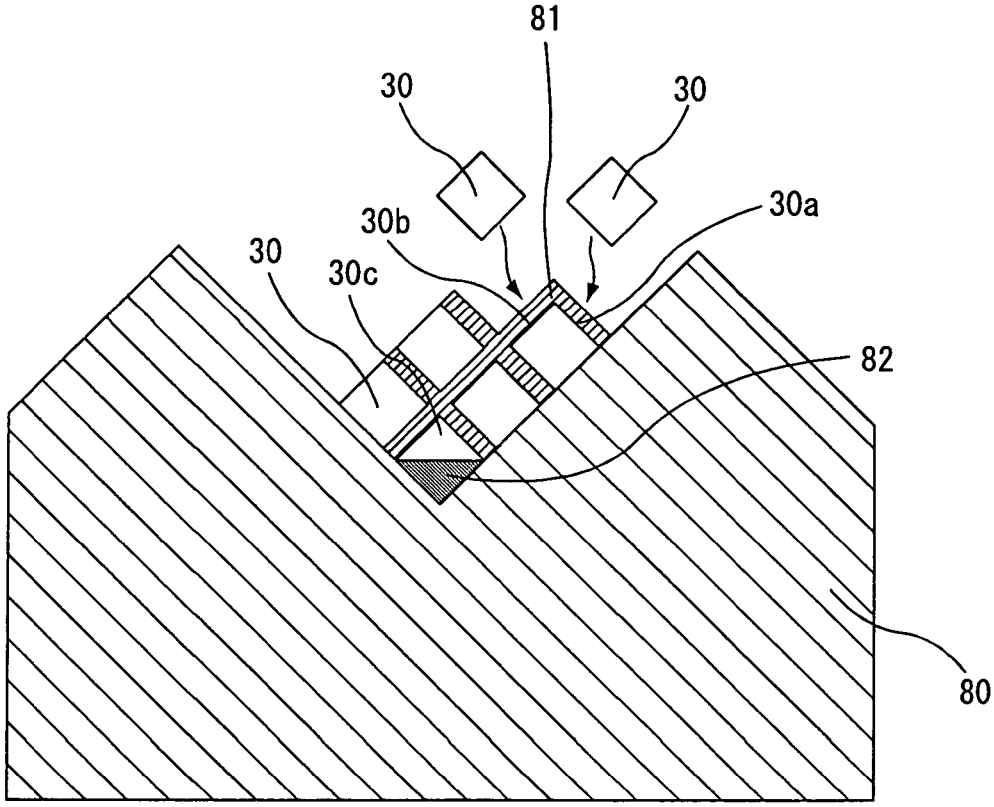
FIG. 5 is a side view that schematically shows a state where the honeycomb filter for purifying exhaust gases of the present invention is manufactured.

Next, as shown in FIG. 5, porous ceramic members 30 are placed on a base 80 the upper portion of which is designed to have a V-shape in its cross-section so as to allow the porous ceramic members 30 to be stacked thereon in a tilted manner, and sealing material paste to form a sealing material layer 24 is then applied onto two side faces 30*a* and 30*b* facing upward with an even thickness to form a sealing material paste layer 81; thereafter, a laminating process for forming another porous ceramic member 30 on this sealing material paste layer 81 is successively repeated, so that a rectangular columnar laminated body 30 having a predetermined size is manufactured. At this time, with respect to the porous ceramic members 30 corresponding to four corners of the laminated body of the rectangular columnar porous ceramic member 30, a triangular columnar porous ceramic member 30*c*, which is formed by cutting a quadrangular columnar porous ceramic member 30 into two, is bonded to a resin member 82 having the same shape as the triangular columnar porous ceramic member 30*c* by using a both-sided tape with easy peelability to prepare a corner member, and these corner members are used for the four corners of the laminated body, and after the lamination processes of the porous ceramic members 30, all the resin members 82 forming the four corners of the laminated body of the rectangular columnar ceramic member 30 are removed; thus, a laminated body of the rectangular columnar porous ceramic member 30 is allowed to have a polygonal column-shape in its cross section. With this arrangement, it is possible to reduce the quantity of a waste corresponding to porous ceramic members to be disposed of, after the formation of the ceramic block 25 by cutting the peripheral portion of the laminated body of the rectangular columnar porous ceramic member 30.

With respect to the method for manufacturing the laminated body of the porous ceramic member 30 having a polygonal column-shape in its cross section except for the method shown in FIG. 5, for example, a method in which the porous ceramic members to be located on four corners are omitted and a method in which porous ceramic members having a triangular shape are combined with one another may be used, in accordance with the shape of a honeycomb filter to be manufactured. Here, a laminated body of a quadrangular columnar ceramic member 30 may of course be manufactured.

Here, with respect to the material used for forming the sealing material paste, the same materials as described in the honeycomb filter of the present invention may be used; therefore, the description thereof will not be given.

Next, the laminated body of this porous ceramic member 30 is heated so that the sealing material paste layer 81 is dried and solidified to form a sealing material layer 24, and the peripheral portion of this is then cut into a shape as shown in FIG. 2 by using, for example, a diamond cutter so that a ceramic block 25 is manufactured.

Then, a sealing material layer 26 is formed on the circumference of the ceramic block 25 by using the sealing material paste, so that a honeycomb filter having a structure in that a plurality of porous ceramic members are combined with one another through sealing material layers is manufactured.

Each of the honeycomb filters manufactured in this manner has a column shape, and also has a structure in that a number of through holes are placed in parallel with one another with partition wall interposed therebetween.

In the case where the honeycomb filter has a structure formed by a single sintered body as a whole as shown in FIG. 1, the wall portion separating a number of through holes from each other functions as filters for collecting particles as a whole; in contrast, in the case where the honeycomb filter has a structure in that a plurality of porous ceramic members are combined with one another through sealing material layers, since the wall portion separating a number of through holes is constituted by a partition wall forming the porous ceramic member and a sealing material layer used for combining the porous ceramic members as shown in FIG. 2, one portion thereof, that is, the partition wall portion that is not made in contact with the sealing material layer of the porous ceramic member is allowed to function as the filter for collecting particles.

The honeycomb filter of the present invention is placed and used in an exhaust gas purifying apparatus to be installed in an exhaust passage of an internal combustion engine such as an engine. Here, in the honeycomb filter of the present invention, with respect to the recycling method for removing fine particles that have been collected and accumulated, for example, a method in which a back-washing process is carried out by utilizing gas flows and a method in which exhaust gases are heated and directed to flow therein are desirably used.

Figure 6:
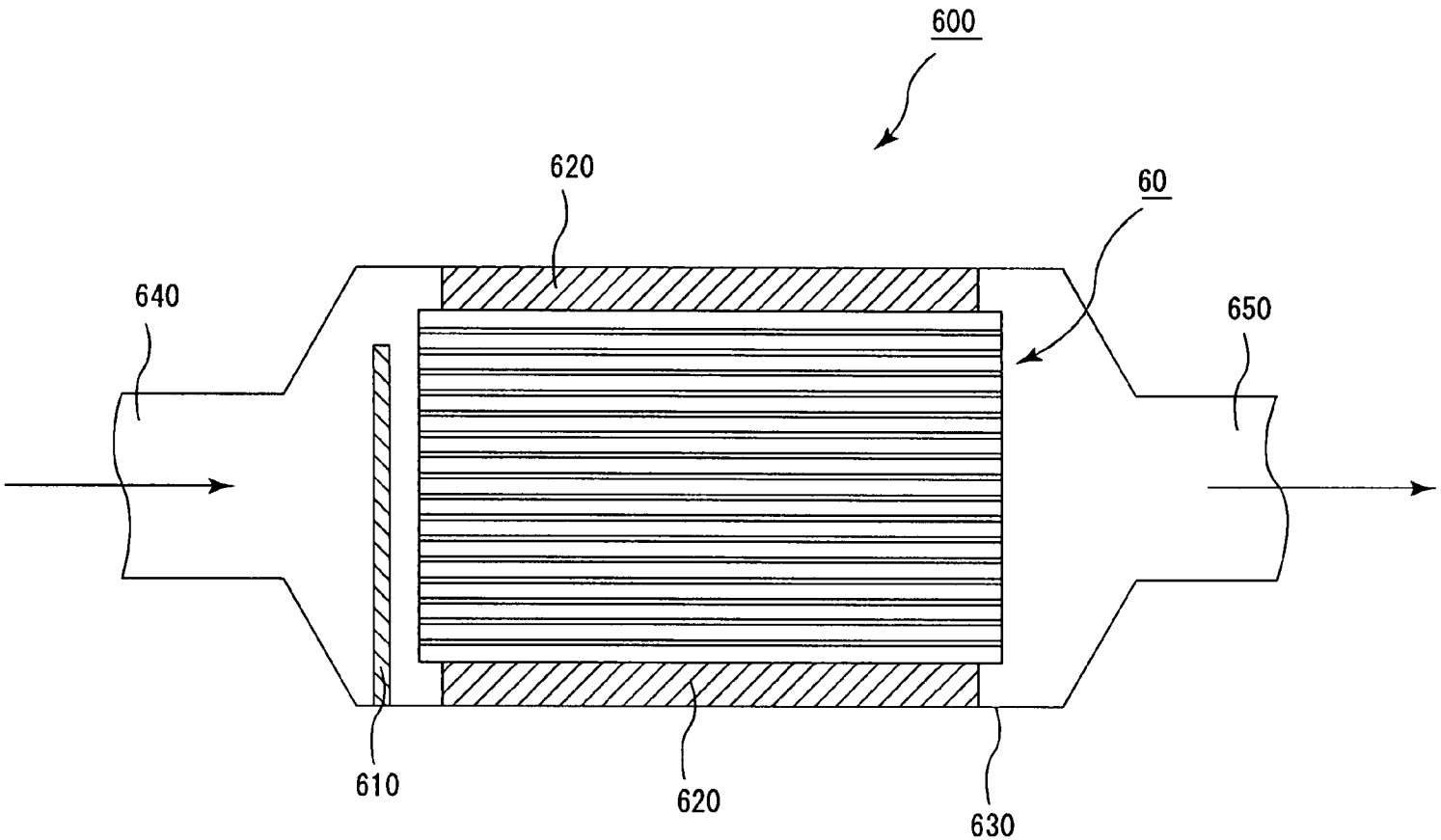
FIG. 6 is a cross-sectional view that schematically shows one example of an exhaust gas purifying apparatus to which the honeycomb filter for purifying exhaust gases of the present invention is attached.

FIG. 6 is a cross-sectional view that schematically shows one example of an exhaust gas purifying apparatus in which the honeycomb filter of the present invention is installed. Here, in the honeycomb filter of the present invention shown in FIG. 6, the method in which exhaust gases are heated and directed to flow therein is used as the recycling method for removing fine particles that have been collected and accumulated.

As shown in FIG. 6, an exhaust gas purifying apparatus 600 is mainly constituted by a honeycomb filter 60 of the present invention, a casing 630 that covers the periphery of the honeycomb filter 60, a holding sealing material 620 placed between the honeycomb filter 60 and the casing 630, and a heating means 610 provided on the exhaust gas inlet side of the honeycomb filter 60, and an introduction pipe 640, coupled to an internal combustion engine such an engine or the like, is connected to one end on the side to which exhaust gases of the casing 630 are introduced, and a discharging pipe 650, lead to the outside, is connected to the other end of the casing 630. Here, in FIG. 6, arrows indicate flows of the exhaust gases.

Here, in FIG. 6, the honeycomb filter 60 may be prepared as the honeycomb filter 10 shown in FIG. 1, or as the honeycomb filter 20 shown in FIG. 2.

In the exhaust gas purifying apparatus 600 of the present invention having the above-mentioned arrangement, exhaust gases, discharged from an internal combustion engine such as an engine or the like, are introduced into the casing 630 through the introduction pipe 640, and allowed to pass through a wall portion (partition wall) from the through hole of the honeycomb filter 60 so that, after particulates therein have been collected through this wall portion (partition wall) so that the exhaust gases have been purified, the resulting exhaust gases are discharged outside through the discharging pipe 650.

When a large amount of particulates have accumulated on the wall portion (partition wall) of the honeycomb filter 60 to cause a high back pressure, a recycling process is carried out on the honeycomb filter 60.

In the above-mentioned recycling process, exhaust gases, heated by the heating means 610, are allowed to flow into the through holes of the honeycomb filter 60, so that the honeycomb filter 60 is heated and the particulates accumulated on the wall portion (partition wall) are burned and removed.

The material for the holding sealing material 620 is not particularly limited, and examples thereof may include inorganic fibers such as crystalline alumina fibers, alumina-silica fibers, silica fibers and the like, and fibers containing one or more kinds of these inorganic fibers.

Moreover, the holding sealing material 620 desirably contains alumina and/or silica. This structure makes it possible to provide superior heat resistance and durability in the holding sealing material 620. In particular, the holding sealing material 620 desirably contains 50% by weight or more of alumina. This structure makes it possible to provide improved elasticity even under high temperatures in a range from 900 to 950° C., and consequently to enhance the holding strength for the honeycomb filter 60.

Furthermore, desirably, the holding sealing material 620 is subjected to a needle punching process. This arrangement allows the fibers constituting the holding sealing material 620 to entangle with one another to improve elasticity and enhance the holding strength for the honeycomb filter 60.

With respect to the shape of the holding sealing material 620, not particularly limited as long as it can be applied onto the circumference of the honeycomb filter 60, any optional shape may be used. The following shape is proposed: a convex portion is formed on one side of a base portion having a rectangular shape, with a concave section being formed in the side opposing to the one side, so that when put on the circumference of the honeycomb filter 60, the convex portion and the concave section are just fitted to each other. This structure makes the holding sealing material 620 covering the circumference of the honeycomb filter 60 less likely to cause deviations.

With respect to the material for the casing 630, although not particularly limited, for example, stainless steel may be used.

Figure 7:
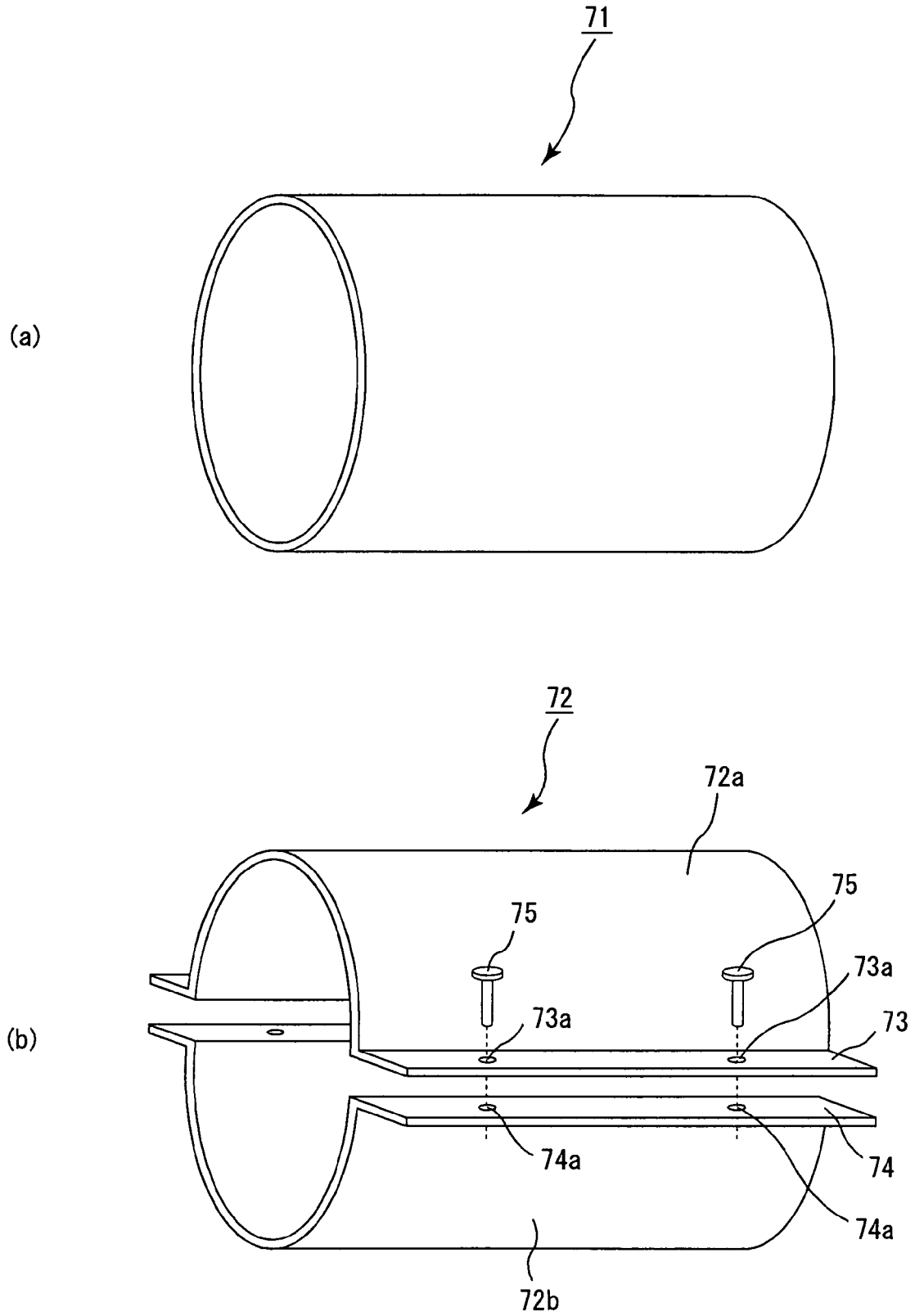
FIG. 7(*a*) is a perspective view that schematically shows one example of a casing to be used in the exhaust gas purifying apparatus shown in FIG. 6, and FIG. 7(*b*) is a perspective view that schematically shows one example of another casing.

Moreover, with respect to the shape of the casing, although not particularly limited, a cylindrical shape as shown by a casing 71 of FIG. 7(*a*) may be used, or a two-division shell shape in which a cylinder is divided into two portions in its axis direction as shown by a casing 72 of FIG. 7(*b*) may be used.

The size of the casing 630 is appropriately adjusted so that the honeycomb filter 60 is placed therein through the holding sealing material 620. As shown in FIG. 6, the introduction pipe 640 used for introducing exhaust gases is connected to one of the end faces of the casing 630, and the discharging pipe 650 for discharging exhaust gases is connected to the other end face.

The heating means 610, which is installed so as to heat the gas to be made to flow into the through holes to burn and remove the particulates deposited on the wall portion (partition wall) in the recycling process of the honeycomb filter 60 as described above. The heating means 610 is not particularly limited, and examples thereof may include an electric heater, a burner and the like.

With respect to the gas to be made to flow into the through holes, for example, exhaust gases or air and the like are used.

Moreover, as shown in FIG. 6, the exhaust gas purifying apparatus of the present invention may have a system in which the honeycomb filter 60 is heated by the heating means 610 provided on the exhaust gas inlet side of the honeycomb filter 60, or a system in which an oxidizing catalyst is supported on the honeycomb filter, with hydrocarbon being allowed to flow into the honeycomb filter supporting the oxidizing catalyst, so that the honeycomb filter is heated, or a system in which an oxidizing catalyst is placed on the exhaust gas inlet side of the honeycomb filter and the oxidizing catalyst is allowed to generate heat by supplying hydrocarbon to the oxidizing catalyst so that the honeycomb filter is heated.

Since the reaction between the oxidizing catalyst and hydrocarbon is a heat generating reaction, the honeycomb filter can be regenerated in parallel with the exhaust gas purifying process, by utilizing a large amount of heat generated during the reaction.

Upon manufacturing an exhaust gas purifying apparatus in which the honeycomb filter of the present invention is installed, first, a holding sealing material with which the circumference of the honeycomb filter of the present invention is coated is prepared.

In order to form the holding sealing material, first, an inorganic mat-shaped matter (web) is formed by using inorganic fibers, such as crystalline alumina fibers, alumina-silica fibers and silica fibers, and fibers and the like containing one or more kinds of these inorganic fibers.

Here, the method for forming the above-mentioned inorganic mat-shaped matter is not particularly limited, and example thereof may include a method in which the above-mentioned fibers and the like are dispersed in a solution containing a bonding agent so that, by utilizing a paper machine and the like for forming paper, an inorganic mat-shaped matter is formed, and other methods.

Moreover, the above-mentioned inorganic mat-shaped matter is desirably subjected to a needle punching process. This needle punching process allows the fibers to entangle with one another so that it is possible to prepare a holding sealing material that has high elasticity and is superior in the holding strength for the honeycomb filter.

Thereafter, the above-mentioned inorganic mat-shaped matter is subjected to a cutting process so that a holding sealing material, which has the above-mentioned shape in which a convex portion is formed on one side of a base portion having a rectangular shape, with a concave section being formed in the side opposing to the one side, is formed.

Next, the circumference of the honeycomb filter of the present invention is coated with the above-mentioned holding sealing material so that the holding sealing material is fixed thereon.

The means for fixing the above-mentioned holding sealing material is not particularly limited, and examples thereof may include means for bonding the holding sealing material by a bonding agent, means for tying it by using a string-shaped member, and the like. Moreover, the sequence may proceed to the next process with the honeycomb filter being coated with the holding sealing material, without fixing it by using any specific means. Here, the above-mentioned string-shaped member may be made of a material to be decomposed through heat. Even if the string-shaped member is decomposed through heat after the honeycomb filter has been placed inside the casing, the holding sealing material is free from peeling since the honeycomb filter has already been installed inside the casing.

Next, the honeycomb filter that has been subjected to the above-mentioned processes is installed inside the casing.

Here, since the material, shape, structure and the like of the above-mentioned casing have been described above, the description thereof will not be given.

With respect to the method for installing the honeycomb filter in the casing, in the case where the casing is prepared as a cylinder-shaped casing 71 (FIG. 7(*a*)), for example, the following method is proposed: a honeycomb filter coated with the holding sealing material is pushed into one of its end faces, and after having been placed at a predetermined position, end faces to be connected to an introduction pipe, piping, a discharging pipe and the like are formed on the two ends of the casing 71. Here, the casing 71 may have a cylinderical shape with a bottom face.

In this structure, in order to prevent the secured honeycomb filter from easily moving, factors, such as the thickness of the holding sealing material, the size of the honeycomb filter, the size of the honeycomb filter and the size of the casing 71, need to be adjusted to a degree in which the pushing process can be carried out with a considerably high pressing force being applied.

Moreover, in the case where the casing is prepared as a two-division shell-shaped casing 72 as shown in FIG. 7(*b*), for example, the following method is proposed: after a honeycomb filter has been installed at a predetermined position inside a semicylinder-shaped lower shell 72*b*, a semicylinder-shaped upper shell 72*a* is placed on the lower shell 72*b* so that through holes 73*a* formed in an upper fixing portion 73 and through holes 74*a* formed in a lower fixing portion 74 are made coincident with each other. Further, a bolt 75 is inserted through each of the through holes 73*a* and 74*a* and fastened with a nut or the like so that the upper shell 72*a* and the lower shell 72*b* are secured to each other. Then, end faces that have openings to be connected to an introduction pipe, piping, a discharging pipe and the like are formed on two ends of the casing 72. In this case also, in order to prevent the secured honeycomb filter from moving, the factors, such as the thickness of the holding sealing material, the size of the honeycomb filter, the size of the honeycomb filter and the size of the casing 72, need to be adjusted.

This two-division shell-shaped casing 72 makes it possible to carry out exchanging processes for the honeycomb filter installed inside thereof more easily in comparison with the cylinder-shaped casing 71.

Next, heating means, which is used for heating gases to be allowed to flow into the through holes in the honeycomb filter upon carrying out a recycling process for the honeycomb filter of the present invention, is provided therein.

The heating means is not particularly limited and, examples thereof may include an electric heater, a burner or the like.

The above-mentioned heating means is normally provided in the vicinity of the end face on the exhaust gas inlet side of the honeycomb filter installed inside the casing.

Additionally, as described in the above-mentioned exhaust gas purifying apparatus, the oxidizing catalyst may be supported on the honeycomb filter of the present invention without installing the above-mentioned heating means, or the oxidizing catalyst may be placed on the exhaust gas inlet side of the honeycomb filter.

Next, the casing in which the honeycomb filter of the present invention and the heating means are installed is connected to an exhaust gas passage of an internal combustion engine, so that an exhaust gas purifying apparatus in which the honeycomb filter of the present invention is installed can be manufactured.

More specifically, the end face of the casing on the side to which the heating means is attached is connected to the introduction pipe that is coupled to the internal combustion engine such as an engine or the like, with the other end face being connected to the discharging pipe connected to the outside.

BEST MODE FOR CARRYING OUT THE INVENTION

Hereinafter, description will be given of the present invention in detail by means of examples; however, the present invention is not intended to be limited by these examples.

EXAMPLE 1

(1) Powder of α-type silicon carbide having an average particle size of 10 μm (70% by weight) and powder of β-type silicon carbide having an average particle size of 0.5 μm (30% by weight) were wet-mixed, and to 100 parts by weight of the resulting mixture were added and kneaded 10 parts by weight of an organic binder (methyl cellulose), 18 parts by weight of water and 3 parts by weight of a pore-forming agent (spherical acryl particles, average particle size: 10 μm) to prepare a raw material paste.

Next, the above-mentioned raw material paste was loaded into an extrusion-molding machine, and extruded at an extruding rate of 10 cm/min so that a ceramic formed body having almost the same shape as the porous ceramic member 30 shown in FIG. 3 was formed, and the ceramic formed body was dried by using a microwave dryer to prepare a ceramic dried body.

Next, powder of α-type silicon carbide having an average particle size of 10 μm (60% by weight) and powder of β-type silicon carbide having an average particle size of 0.5 μm (40% by weight) were wet-mixed, and to 100 parts by weight of the resulting mixture were added 4 parts by weight of a lubricant made of polyoxyethylene monobutyl ether (trade name: Uniloop, made by NOF Corporation), 11 parts by weight of a solvent made of diethylene glycol mono-2-ethylhexyl ether (trade name: OX-20, made by Kyowa Hakkou Co., Ltd.), 2 parts by weight of a dispersant made of a phosphate-based compound (trade name: Plysurf, made by Daiichi Kogyo Seiyaku K.K.) and 5 parts by weight of a binder prepared by dissolving n-butyl methacrylate in OX-20 (trade name: Binder D, made by Toei Kasei Co., Ltd.) so as to be evenly mixed; thus, plug paste was prepared.

This plug paste was loaded into the plug discharging tank 110 of the mouth-sealing apparatus 100 shown in FIG. 4, and the ceramic dried body, formed in the above-mentioned process, was moved and secured to a predetermined position; then, the plug discharging tank 110 was moved so that the mask 111 was made in contact with the end face of the ceramic dried body. At this time, the opening section 111*a* of the mask 111 and the through hole of the ceramic dried body were aligned face to face with each other.

Next, a predetermined pressure was applied to the plug discharging tank 110 by using a mono-pump, so that the plug paste was discharged from the opening section 111*a* of the mask 111, and allowed to enter the end portion of the through hole of the ceramic block dried body; thus, a mouth-sealing process was carried out.

At this time, the plug paste was injected in such a manner that the length in the length direction of the through hole of the plug to be formed after a firing process is set to 0.75 mm.

Next, the ceramic dried body that had been subjected to the mouth-sealing process was again dried by using a microwave drier, the resulting dried body was then degreased at 400° C., and fired at 2200° C. in a normal-pressure argon atmosphere for 4 hours to manufacture a porous ceramic member, as shown in FIG. 2, which was made of a silicon carbide sintered body, and had a size of 33 mm×33 mm×300 mm, the number of through holes of 31 pcs/$cm^2$ and a thickness of the partition wall of 0.3 mm.

(2) Next, a number of the porous ceramic members were combined with one another by using a heat-resistant adhesive paste containing 19.6% by weight of alumina fibers having a fiber length of 0.2 mm, 67.8% by weight of silicon carbide particles having an average particle size of 0.6 μm, 10.1% by weight of silica sol and 2.5% by weight of carboxy methyl cellulose through the method described with reference to FIG. 5, and then cut by using a diamond cutter; thus, a cylinder-shaped ceramic block having a diameter of 165 mm, as shown in FIG. 2, was obtained.

Next, ceramic fibers made of alumina silicate (shot content: 3%, fiber length: 0.1 to 100 mm) (23.3% by weight) which served as inorganic fibers, silicon carbide powder having an average particle size of 0.3 μm (30.2% by weight), which served as inorganic particles, silica sol ($SiO_2$ content in the sol: 30% by weight) (7% by weight), which served as an inorganic binder, carboxymethyl cellulose (0.5% by weight), which served as an organic binder, and water (39% by weight) were mixed and kneaded to prepare a sealing material paste.

Next, a sealing material paste layer having a thickness of 1.0 mm was formed on the circumferential portion of the ceramic block by using the above-mentioned sealing material paste. Further, this sealing material paste layer was dried at 120° C., so that a cylinder-shaped honeycomb filter made of silicon carbide, as shown in FIG. 2, was manufactured.

The honeycomb filter thus manufactured had an average pore diameter of 10 μm with a porosity of 40%, and also had a bending strength of 40 MPa. Moreover, the length of the plug in the length direction of the through hole was 0.75 mm, and the product of the bending strength and the length of the plug of the honeycomb filter was 30.

EXAMPLE 2

The same processes as those of Example 1 were carried out except that the plug paste was injected in such a manner that the length of the plug in the length direction of the through hole was set to 3 mm; thus, a honeycomb filter made of silicon carbide was manufactured.

The product of the bending strength and the length of the plug of the honeycomb filter according to Example 2 was 120.

EXAMPLE 3

The same processes as those of Example 1 were carried out except that the plug paste was injected in such a manner that the length of the plug in the length direction of the through hole was set to 5 mm; thus, a honeycomb filter made of silicon carbide was manufactured.

The product of the bending strength and the length of the plug of the honeycomb filter according to Example 3 was 200.

COMPARATIVE EXAMPLE 1

The same processes as those of Example 1 were carried out except that the plug paste was injected in such a manner that the length of the plug in the length direction of the through hole was set to 0.5 mm; thus, a honeycomb filter made of silicon carbide was manufactured.

The product of the bending strength and the length of the plug of the honeycomb filter according to Comparative Example 1 was 20.

TEST EXAMPLE 1

The same processes as those of Example 1 were carried out except that the plug paste was injected in such a manner that the length of the plug in the length direction of the through hole was set to 6 mm; thus, a honeycomb filter made of silicon carbide was manufactured.

The product of the bending strength and the length of the plug of the honeycomb filter according to Test Example 1 was 240.

EXAMPLE 4

Powder of α-type silicon carbide having an average particle size of 10 μm (80% by weight) and powder of β-type silicon carbide having an average particle size of 0.5 μm (20% by weight) were wet-mixed, and to 100 parts by weight of the resulting mixture were added and kneaded 20 parts by weight of an organic binder (methyl cellulose), 30 parts by weight of water and 20 parts by weight of a pore-forming agent (spherical acryl particles, average particle size: 10 μm) to prepare a raw material paste.

Next, the above-mentioned raw material paste was loaded into an extrusion-molding machine, and extruded at an extruding rate of 10 cm/min to prepare a ceramic formed body, and this ceramic formed body was dried by using a microwave dryer, so that a ceramic dried body having almost the same shape as the porous ceramic member 30 shown in FIG. 3 was formed.

Next, plug paste was prepared by carrying out the same processes as those of Example 1, and the above-mentioned ceramic dried body was subjected to a mouth-sealing process. At this time, the plug paste was injected in such a manner that the length in the length direction of the through hole of the plug to be formed after a firing process was set to 4.3 mm.

Further, the ceramic dried body having been subjected to the mouth-sealing process was subjected to degreasing and firing processes under the same conditions as Example 1 so that a porous ceramic member was manufactured.

The same processes as those of (2) of Example 1 were then carried out so that a cylinder-shaped honeycomb filter made of silicon carbide, as shown in FIG. 2, was manufactured.

The honeycomb filter thus manufactured had an average pore diameter of 10 μm with a porosity of 60%, and also had a bending strength of 7 MPa. Moreover, the length of the plug in the length direction of the through hole was 4.3 mm, and the product of the bending strength and the length of the plug of the honeycomb filter was 30.1.

EXAMPLE 5

The same processes as those of Example 4 were carried out except that the plug paste was injected in such a manner that the length of the plug in the length direction of the through hole was set to 15 mm; thus, a honeycomb filter made of silicon carbide was manufactured.

The product of the bending strength and the length of the plug of the honeycomb filter according to Example 5 was 105.

EXAMPLE 6

The same processes as those of Example 4 were carried out except that the plug paste was injected in such a manner that the length of the plug in the length direction of the through hole was set to 28.5 mm; thus, a honeycomb filter made of silicon carbide was manufactured.

The product of the bending strength and the length of the plug of the honeycomb filter according to Example 6 was 199.5.

COMPARATIVE EXAMPLE 2

The same processes as those of Example 4 were carried out except that the plug paste was injected in such a manner that the length of the plug in the length direction of the through hole was set to 4 mm; thus, a honeycomb filter made of silicon carbide was manufactured.

The product of the bending strength and the length of the plug of the honeycomb filter according to Comparative Example 2 was 28.

TEST EXAMPLE 2

The same processes as those of Example 4 were carried out except that the plug paste was injected in such a manner that the length of the plug in the length direction of the through hole was set to 30 mm; thus, a honeycomb filter made of silicon carbide was manufactured.

The product of the bending strength and the length of the plug of the honeycomb filter according to Test Example 2 was 210.

EXAMPLE 7

Powder of α-type silicon carbide having an average particle size of 10 μm (70% by weight) and powder of β-type silicon carbide having an average particle size of 0.5 μm (30% by weight) were wet-mixed, and to 100 parts by weight of the resulting mixture were added and kneaded 15 parts by weight of an organic binder (methyl cellulose), 22 parts by weight of water and 5 parts by weight of a pore-forming agent (spherical acryl particles, average particle size: 10 μm) to prepare a raw material paste.

Next, the above-mentioned raw material paste was loaded into an extrusion-molding machine, and extruded at an extruding rate of 10 cm/min to prepare a ceramic formed body, and this ceramic formed body was dried by using a microwave dryer so that a ceramic dried body having almost the same shape as the porous ceramic member 30 shown in FIG. 3 was formed.

Next, plug paste was prepared by carrying out the same processes as those of Example 1, and the above-mentioned ceramic dried body was subjected to a mouth-sealing process. At this time, the plug paste was injected in such a manner that the length in the length direction of the through hole of the plug to be formed after a firing process was set to 1.5 mm.

Further, the ceramic dried body having been subjected to the mouth-sealing process was subjected to degreasing and firing processes under the same conditions as Example 1, so that a porous ceramic member was manufactured.

The same processes as those of (2) of Example 1 were then carried out so that a cylinder-shaped honeycomb filter made of silicon carbide, as shown in FIG. 2, was manufactured.

The honeycomb filter thus manufactured had an average pore diameter of 10 μm with a porosity of 50%, and also had a bending strength of 20 MPa. Moreover, the length of the plug in the length direction of the through hole was 1.5 mm, and the product of the bending strength and the length of the plug of the honeycomb filter was 30.

EXAMPLE 8

The same processes as those of Example 7 were carried out except that the plug paste was injected in such a manner that the length of the plug in the length direction of the through hole was set to 6 mm; thus, a honeycomb filter made of silicon carbide was manufactured.

The product of the bending strength and the length of the plug of the honeycomb filter according to Example 8 was 120.

EXAMPLE 9

The same processes as those of Example 7 were carried out except that the plug paste was injected in such a manner that the length of the plug in the length direction of the through hole was set to 10 mm; thus, a honeycomb filter made of silicon carbide was manufactured.

The product of the bending strength and the length of the plug of the honeycomb filter according to Example 9 was 200.

COMPARATIVE EXAMPLE 3

The same processes as those of Example 7 were carried out except that the plug paste was injected in such a manner that the length of the plug in the length direction of the through hole was set to 1 mm; thus, a honeycomb filter made of silicon carbide was manufactured.

The product of the bending strength and the length of the plug of the honeycomb filter according to Comparative Example 3 was 20.

TEST EXAMPLE 3

The same processes as those of Example 7 were carried out except that the plug paste was injected in such a manner that the length of the plug in the length direction of the through hole was set to 12 mm; thus, a honeycomb filter made of silicon carbide was manufactured.

The product of the bending strength and the length of the plug of the honeycomb filter according to Test Example 3 was 240.

EXAMPLE 10

Powder of α-type silicon carbide having an average particle size of 10 μm (60% by weight) and powder of β-type silicon carbide having an average particle size of 0.5 μm (40% by weight) were wet-mixed, and to 100 parts by weight of the resulting mixture were added and kneaded 5 parts by weight of an organic binder (methyl cellulose) and 10 parts by weight of water to prepare a raw material paste.

Next, the above-mentioned raw material paste was loaded into an extrusion-molding machine, and extruded at an extruding rate of 10 cm/min to prepare a ceramic formed body, and this ceramic formed body was dried by using a microwave dryer so that a ceramic dried body having almost the same shape as the porous ceramic member 30 shown in FIG. 3 was formed.

Next, plug paste was prepared by carrying out the same processes as those of Example 1, and the above-mentioned ceramic dried body was subjected to a mouth-sealing process. At this time, the plug paste was injected in such a manner that the length in the length direction of the through hole of the plug to be formed after a firing process was set to 0.5 mm.

Further, the ceramic dried body having been subjected to the mouth-sealing process was subjected to degreasing and firing processes under the same conditions as Example 1 so that a porous ceramic member was manufactured.

The same processes as those of (2) of Example 1 were then carried out so that a cylinder-shaped honeycomb filter made of silicon carbide, as shown in FIG. 2, was manufactured.

The honeycomb filter thus manufactured had an average pore diameter of 10 μm with a porosity of 30%, and also had a bending strength of 60 MPa. Moreover, the length of the plug in the length direction of the through hole was 0.5 mm, and the product of the bending strength and the length of the plug of the honeycomb filter was 30.

EXAMPLE 11

The same processes as those of Example 10 were carried out except that the plug paste was injected in such a manner that the length of the plug in the length direction of the through hole was set to 2 mm; thus, a honeycomb filter made of silicon carbide was manufactured.

The product of the bending strength and the length of the plug of the honeycomb filter according to Example 11 was 120.

EXAMPLE 12

The same processes as those of Example 10 were carried out except that the plug paste was injected in such a manner that the length of the plug in the length direction of the through hole was set to 3.3 mm; thus, a honeycomb filter made of silicon carbide was manufactured.

The product of the bending strength and the length of the plug of the honeycomb filter according to Example 12 was 198.

COMPARATIVE EXAMPLE 4

The same processes as those of Example 10 were carried out except that the plug paste was injected in such a manner that the length of the plug in the length direction of the through hole was set to 0.3 mm; thus, a honeycomb filter made of silicon carbide was manufactured.

The product of the bending strength and the length of the plug of the honeycomb filter according to Comparative Example 4 was 18.

TEST EXAMPLE 4

The same processes as those of Example 10 were carried out except that the plug paste was injected in such a manner that the length of the plug in the length direction of the through hole was set to 4 mm; thus, a honeycomb filter made of silicon carbide was manufactured.

The product of the bending strength and the length of the plug of the honeycomb filter according to Test Example 4 was 240.

EXAMPLE 13

(1) Talc having an average particle size of 10 μm (40 parts by weight), kaolin having an average particle size of 9 μm (10 parts by weight), alumina having an average particle size of 9.5 μm (17 parts by weight), aluminum hydroxide having an average particle size of 5 μm (16 parts by weight), silica having an average particle size of 10 μm (15 parts by weight), graphite having an average particle size of 10 μm (30 parts by weight), a molding auxiliary (ethylene glycol) (17 parts by weight) and water (25 parts by weight) were mixed and kneaded to prepare a raw material paste.

Next, the above-mentioned raw material paste was loaded into an extrusion-molding machine, and extruded at an extruding rate of 10 cm/min, so that a ceramic formed body having almost the same shape as the honeycomb filter 10 shown in FIG. 1 was formed, and the ceramic formed body was dried by using a microwave dryer to prepare a ceramic dried body.

Next, talc having an average particle size of 10 μm (40 parts by weight), kaolin having an average particle size of 9 μm (10 parts by weight), alumina having an average particle size of 9.5 μm (17 parts by weight), aluminum hydroxide having an average particle size of 5 m (16 parts by weight), silica having an average particle size of 10 μm (15 parts by weight), a lubricant made of polyoxyethylene monobutyl ether (trade name: Uniloop, made by NOF Corporation) (4 parts by weight), a solvent made of diethylene glycol mono-2-ethylhexyl ether (tradename: OX-20, made by Kyowa Hakkou Co., Ltd.) (11 parts by weight), a dispersant made of a phosphate-based compound (trade name: Plysurf, made by Daiichi Kogyo Seiyaku K.K.) (2 parts by weight) and a binder prepared by dissolving n-butylmethacrylate in OX-20 (tradename: Binder D, made by Toei Kasei Co., Ltd.) (5 parts by weight) were blended and evenly mixed; thus, plug paste was prepared.

The same processes as those of Example 1 were carried out by using this plug paste so that the ceramic dried body was subjected to a mouth-sealing process.

At this time, the plug paste was injected in such a manner that the length of the plug to be formed after a firing process is set to 7.5 mm.

In this case, since the shape of the end face of the ceramic dried body according to Example 13 was completely different from the shape of the end face of the ceramic dried body according to Example 1, a mask that is different from the mask used in the mouth-sealing process of the ceramic dried body according to Example 1 was used in the above-mentioned mouth-sealing process.

In other words, in the mouth-sealing process of the ceramic dried body according to Example 13, a mask having an opening section at a position right opposing to the through hole of the ceramic dried body was used.

Then, the ceramic dried body that had been subjected to the mouth-sealing process was again dried by using a microwave drier, and the resulting dried body was then degreased at 400° C., and fired at 1400° C. in a normal-pressure argon atmosphere for 3 hours to manufacture a cylinder-shaped honeycomb filter made of cordierite having a diameter of 165 mm with a width of 300 mm, as shown in FIG. 1.

The honeycomb filter thus manufactured had a porosity of 60% and a bending strength of 4 MPa. Moreover, the length of the plug in the length direction of the through hole was 7.5 mm, and the product of the bending strength and the length of the plug of the honeycomb filter was 30.

EXAMPLE 14

The same processes as those of Example 13 were carried out except that the plug paste was injected in such a manner that the length of the plug in the length direction of the through hole was set to 20 mm; thus, a honeycomb filter made of cordierite was manufactured.

The product of the bending strength and the length of the plug of the honeycomb filter according to Example 14 was 80.

EXAMPLE 15

The same processes as those of Example 13 were carried out except that the plug paste was injected in such a manner that the length of the plug in the length direction of the through hole was set to 50 mm; thus, a honeycomb filter made of cordierite was manufactured.

The product of the bending strength and the length of the plug of the honeycomb filter according to Example 15 was 200.

COMPARATIVE EXAMPLE 5

The same processes as those of Example 13 were carried out except that the plug paste was injected in such a manner that the length of the plug in the length direction of the through hole was set to 7 mm; thus, a honeycomb filter made of cordierite was manufactured.

The product of the bending strength and the length of the plug of the honeycomb filter according to Comparative Example 5 was 28.

TEST EXAMPLE 5

The same processes as those of Example 13 were carried out except that the plug paste was injected in such a manner that the length of the plug in the length direction of the through hole was set to 60 mm; thus, a honeycomb filter made of cordierite was manufactured.

The product of the bending strength and the length of the plug of the honeycomb filter according to Test Example 5 was 240.

EXAMPLE 16

Talc having an average particle size of 10 μm (40 parts by weight), kaolin having an average particle size of 9 μm (10 parts by weight), alumina having an average particle size of 9.5 μm (17 parts by weight), aluminum hydroxide having an average particle size of 5 μm (16 parts by weight), silica having an average particle size of 10 μm (15 parts by weight), graphite having an average particle size of 10 μm (3 parts by weight), a molding auxiliary (ethylene glycol) (10 parts by weight) and water (18 parts by weight) were mixed and kneaded to prepare a raw material paste.

Next, the above-mentioned material paste was loaded into an extrusion-molding machine, and extruded at an extruding rate of 10 cm/min to prepare a ceramic formed body, and this ceramic formed body was dried by using a microwave dryer, so that a ceramic dried body having almost the same shape as the porous ceramic member 10 shown in FIG. 1 was formed.

Next, plug paste was prepared by carrying out the same processes as those of Example 13, and the above-mentioned ceramic dried body was subjected to a mouth-sealing process. At this time, the plug paste was injected in such a manner that the length in the length direction of the through hole of the plug to be formed after a firing process was set to 3.75 mm.

Further, the ceramic dried body having been subjected to the mouth-sealing process was subjected to degreasing and firing processes under the same conditions as Example 13, so that a cylinder-shaped honeycomb filter made of cordierite, as shown in FIG. 1, was manufactured.

The honeycomb filter thus manufactured had a porosity of 40% and a bending strength of 8 MPa. Moreover, the length of the plug in the length direction of the through hole was 3.75 mm, and the product of the bending strength and the length of the plug of the honeycomb filter was 30.

EXAMPLE 17

The same processes as those of Example 16 were carried out except that the plug paste was injected in such a manner that the length of the plug in the length direction of the through hole was set to 12 mm; thus, a honeycomb filter made of cordierite was manufactured.

The product of the bending strength and the length of the plug of the honeycomb filter according to Example 17 was 96.

EXAMPLE 18

The same processes as those of Example 16 were carried out except that the plug paste was injected in such a manner that the length of the plug in the length direction of the through hole was set to 25 mm; thus, a honeycomb filter made of cordierite was manufactured.

The product of the bending strength and the length of the plug of the honeycomb filter according to Example 18 was 200.

COMPARATIVE EXAMPLE 6

The same processes as those of Example 16 were carried out except that the plug paste was injected in such a manner that the length of the plug in the length direction of the through hole was set to 3 mm; thus, a honeycomb filter made of cordierite was manufactured.

The product of the bending strength and the length of the plug of the honeycomb filter according to Comparative Example 6 was 24.

TEST EXAMPLE 6

The same processes as those of Example 16 were carried out except that the plug paste was injected in such a manner that the length of the plug in the length direction of the through hole was set to 28 mm; thus, a honeycomb filter made of cordierite was manufactured.

The product of the bending strength and the length of the plug of the honeycomb filter according to Test Example 6 was 224.

EXAMPLE 19

Talc having an average particle size of 10 μm (40 parts by weight), kaolin having an average particle size of 9 μm (10 parts by weight), alumina having an average particle size of 9.5 μm (17 parts by weight), aluminum hydroxide having an average particle size of 5 μm (16 parts by weight), silica having an average particle size of 10 μM (15 parts by weight), graphite having an average particle size of 10 μm (25 parts by weight), a molding auxiliary (ethylene glycol) (15 parts by weight) and water (20 parts by weight) were mixed and kneaded to prepare a material paste.

Next, the above-mentioned material paste was loaded into an extrusion-molding machine, and extruded at an extruding rate of 10 cm/min to prepare a ceramic formed body having almost the same shape as the honeycomb filter 10 shown in FIG. 1, and this ceramic formed body was dried by using a microwave dryer to prepare a ceramic dried body.

Next, plug paste was prepared by carrying out the same processes as those of Example 13, and the above-mentioned ceramic dried body was subjected to a mouth-sealing process. At this time, the plug paste was injected in such a manner that the length in the length direction of the through hole of the plug to be formed after a firing process was set to 6.3 mm.

Further, the ceramic dried body having been subjected to the mouth-sealing process was subjected to degreasing and firing processes under the same conditions as Example 13 so that a cylinder-shaped honeycomb filter made of cordierite, as shown in FIG. 1, was manufactured.

The honeycomb filter thus manufactured had a porosity of 55% and a bending strength of 4.7 MPa. Moreover, the length of the plug in the length direction of the through hole was 6.3 mm, and the product of the bending strength and the length of the plug of the honeycomb filter was 30.

EXAMPLE 20

The same processes as those of Example 19 were carried out except that the plug paste was injected in such a manner that the length of the plug in the length direction of the through hole was set to 23 mm; thus, a honeycomb filter made of cordierite was manufactured.

The product of the bending strength and the length of the plug of the honeycomb filter according to Example 20 was 108.

EXAMPLE 21

The same processes as those of Example 19 were carried out except that the plug paste was injected in such a manner that the length of the plug in the length direction of the through hole was set to 42.6 mm; thus, a honeycomb filter made of cordierite was manufactured.

The product of the bending strength and the length of the plug of the honeycomb filter according to Example 21 was 200.

COMPARATIVE EXAMPLE 7

The same processes as those of Example 19 were carried out except that the plug paste was injected in such a manner that the length of the plug in the length direction of the through hole was set to 6 mm; thus, a honeycomb filter made of cordierite was manufactured.

The product of the bending strength and the length of the plug of the honeycomb filter according to Comparative Example 7 was 28.

TEST EXAMPLE 7

The same processes as those of Example 19 were carried out except that the plug paste was injected in such a manner that the length of the plug in the length direction of the through hole was set to 43 mm; thus, a honeycomb filter made of cordierite was manufactured.

The product of the bending strength and the length of the plug of the honeycomb filter according to Test Example 7 was 202.

EXAMPLE 22

Talc having an average particle size of 10 μm (40 parts by weight), kaolin having an average particle size of 9 μm (10 parts by weight), alumina having an average particle size of 9.5 μm (17 parts by weight), aluminum hydroxide having an average particle size of 5 μm (16 parts by weight), silica having an average particle size of 10 μm (15 parts by weight), graphite having an average particle size of 10 μm (40 parts by weight), a molding auxiliary (ethylene glycol) (25 parts by weight) and water (30 parts by weight) were mixed and kneaded to prepare a raw material paste.

Next, the above-mentioned raw material paste was loaded into an extrusion-molding machine, and extruded at an extruding rate of 10 cm/min to prepare a ceramic formed body having almost the same shape as the honeycomb filter 10 shown in FIG. 1, and this ceramic formed body was dried by using a microwave dryer to form a ceramic dried body.

Next, plug paste was prepared by carrying out the same processes as those of Example 13, and the above-mentioned ceramic dried body was subjected to a mouth-sealing process. At this time, the plug paste was injected in such a manner that the length in the length direction of the through hole of the plug to be formed after a firing process was set to 10 mm.

Further, the ceramic dried body having been subjected to the mouth-sealing process was subjected to degreasing and firing processes under the same conditions as Example 13 so that a cylinder-shaped honeycomb filter made of cordierite, as shown in FIG. 1, was manufactured.

The honeycomb filter thus manufactured had a porosity of 70% and a bending strength of 3.0 MPa. Moreover, the length of the plug in the length direction of the through hole was 10 mm, and the product of the bending strength and the length of the plug of the honeycomb filter was 30.

EXAMPLE 23

The same processes as those of Example 22 were carried out except that the plug paste was injected in such a manner that the length of the plug in the length direction of the through hole was set to 38 mm; thus, a honeycomb filter made of cordierite was manufactured.

The product of the bending strength and the length of the plug of the honeycomb filter according to Example 23 was 114.

EXAMPLE 24

The same processes as those of Example 22 were carried out except that the plug paste was injected in such a manner that the length of the plug in the length direction of the through hole was set to 66 mm; thus, a honeycomb filter made of cordierite was manufactured.

The product of the bending strength and the length of the plug of the honeycomb filter according to Example 24 was 198.

COMPARATIVE EXAMPLE 8

The same processes as those of Example 22 were carried out except that the plug paste was injected in such a manner that the length of the plug in the length direction of the through hole was set to 9 mm; thus, a honeycomb filter made of cordierite was manufactured.

The product of the bending strength and the length of the plug of the honeycomb filter according to Comparative Example 8 was 27.

TEST EXAMPLE 8

The same processes as those of Example 22 were carried out except that the plug paste was injected in such a manner that the length of the plug in the length direction of the through hole was set to 70 mm; thus, a honeycomb filter made of cordierite was manufactured.

The product of the bending strength and the length of the plug of the honeycomb filter according to Test Example 8 was 210.

With respect to the ceramic materials mainly constituting the honeycomb filters according to Examples 1 to 24, Comparative Examples 1 to 8 and Test Examples 1 to 8, the bending strength (MPa), the porosity (%) and the length of the plug (mm) are collectively shown in Table 1.

TABLE 1

| | Ceramic material | Bending strength (Mpa) | Porosity (%) | Length of plug (mm) | Product (Note 1) |
|---|---|---|---|---|---|
| Example 1 | Silicon carbide | 40 | 40 | 0.75 | 30 |
| Example 2 | Silicon carbide | 40 | 40 | 3 | 120 |
| Example 3 | Silicon carbide | 40 | 40 | 5 | 200 |
| Example 4 | Silicon carbide | 7 | 60 | 4.3 | 30.1 |
| Example 5 | Silicon carbide | 7 | 60 | 15 | 105 |
| Example 6 | Silicon carbide | 7 | 60 | 28.5 | 199.5 |
| Example 7 | Silicon carbide | 20 | 50 | 1.5 | 30 |
| Example 8 | Silicon carbide | 20 | 50 | 6 | 120 |
| Example 9 | Silicon carbide | 20 | 50 | 10 | 200 |
| Example 10 | Silicon carbide | 60 | 30 | 0.5 | 30 |
| Example 11 | Silicon carbide | 60 | 30 | 2 | 120 |
| Example 12 | Silicon carbide | 60 | 30 | 3.3 | 198 |
| Example 13 | Cordierite | 4 | 60 | 7.5 | 30 |
| Example 14 | Cordierite | 4 | 60 | 20 | 80 |
| Example 15 | Cordierite | 4 | 60 | 50 | 200 |
| Example 16 | Cordierite | 8 | 40 | 3.75 | 30 |
| Example 17 | Cordierite | 8 | 40 | 12 | 96 |
| Example 18 | Cordierite | 8 | 40 | 25 | 200 |
| Example 19 | Cordierite | 4.7 | 55 | 6.3 | 30 |
| Example 20 | Cordierite | 4.7 | 55 | 23 | 108 |
| Example 21 | Cordierite | 4.7 | 55 | 43 | 200 |
| Example 22 | Cordierite | 3 | 70 | 10 | 30 |
| Example 23 | Cordierite | 3 | 70 | 38 | 114 |
| Example 24 | Cordierite | 3 | 70 | 66 | 198 |
| Comparative Example 1 | Silicon carbide | 40 | 40 | 0.5 | 20 |
| Comparative Example 2 | Silicon carbide | 7 | 60 | 4 | 28 |
| Comparative Example 3 | Silicon carbide | 20 | 50 | 1 | 20 |
| Comparative Example 4 | Silicon carbide | 60 | 30 | 0.3 | 18 |
| Comparative Example 5 | Cordierite | 4 | 60 | 7 | 28 |

TABLE 1-continued

| | Ceramic material | Bending strength (Mpa) | Porosity (%) | Length of plug (mm) | Product (Note 1) |
|---|---|---|---|---|---|
| Comparative Example 6 | Cordierite | 8 | 40 | 3 | 24 |
| Comparative Example 7 | Cordierite | 4.7 | 55 | 6 | 28 |
| Comparative Example 8 | Cordierite | 3 | 70 | 9 | 27 |
| Test Example 1 | Silicon carbide | 40 | 40 | 6 | 240 |
| Test Example 2 | Silicon carbide | 7 | 60 | 30 | 210 |
| Test Example 3 | Silicon carbide | 20 | 50 | 12 | 240 |
| Test Example 4 | Silicon carbide | 60 | 30 | 4 | 240 |
| Test Example 5 | Cordierite | 4 | 60 | 60 | 240 |
| Test Example 6 | Cordierite | 8 | 40 | 28 | 224 |
| Test Example 7 | Cordierite | 4.7 | 55 | 43 | 202 |
| Test Example 8 | Cordierite | 3 | 70 | 70 | 210 |

(Note 1) Product: bending strength × Length of plug of Honeycomb filter

With respect to property-evaluation tests on the honeycomb filters according to Examples 1 to 24, Comparative Examples 1 to 8 and Test Examples 1 to 8, the initial back pressure of each of the respective examples, comparative examples and test examples was measured by blowing air at a flow rate of 13 m/s.

Next, each of the honeycomb filters according to the respective examples, comparative examples and test examples was installed in an exhaust gas purifying apparatus, as shown in FIG. 6, that is disposed in an exhaust passage of an engine, and the engine was driven at the number of revolutions of 3000 $min^{-1}$ with a torque of 50 Nm for 10 hours so that an exhaust gas purifying process was carried out. After the above-mentioned endurance test, each of the honeycomb filters was taken out and visually observed as to whether or not any cracks were present. Moreover, the honeycomb filters that had no cracks after the endurance test were further subjected to heat cycle tests in which the above-mentioned endurance tests were repeated 300 times, and each of the honeycomb filters was taken out and visually observed as to whether or not any cracks were present.

The results are shown in Table 2.

TABLE 2

| | Initial back pressure (kPa) | Presence/absence of cracks | |
|---|---|---|---|
| | | After endurance tests | After heat cycle tests |
| Example 1 | 10.0 | Absence | Absence |
| Example 2 | 10.5 | Absence | Absence |
| Example 3 | 11.0 | Absence | Absence |
| Example 4 | 8.0 | Absence | Absence |
| Example 5 | 8.3 | Absence | Absence |
| Example 6 | 8.5 | Absence | Absence |
| Example 7 | 8.5 | Absence | Absence |
| Example 8 | 8.8 | Absence | Absence |
| Example 9 | 9.0 | Absence | Absence |
| Example 10 | 12.0 | Absence | Absence |
| Example 11 | 12.5 | Absence | Absence |
| Example 12 | 13.2 | Absence | Absence |
| Example 13 | 7.0 | Absence | Absence |
| Example 14 | 7.5 | Absence | Absence |
| Example 15 | 7.8 | Absence | Absence |
| Example 16 | 8.0 | Absence | Absence |
| Example 17 | 8.2 | Absence | Absence |
| Example 18 | 9.0 | Absence | Absence |
| Example 19 | 7.7 | Absence | Absence |
| Example 20 | 7.9 | Absence | Absence |
| Example 21 | 8.3 | Absence | Absence |

TABLE 2-continued

| | Initial back pressure (kPa) | Presence/absence of cracks | |
|---|---|---|---|
| | | After endurance tests | After heat cycle tests |
| Example 22 | 7.0 | Absence | Absence |
| Example 23 | 7.3 | Absence | Absence |
| Example 24 | 7.5 | Absence | Absence |
| Comparative Example 1 | 5.0 | Presence | — |
| Comparative Example 2 | 7.0 | Presence | — |
| Comparative Example 3 | 8.0 | Presence | — |
| Comparative Example 4 | 10.0 | Presence | — |
| Comparative Example 5 | 6.0 | Presence | — |
| Comparative Example 6 | 7.0 | Presence | — |
| Comparative Example 7 | 6.3 | Presence | — |
| Comparative Example 8 | 5.3 | Presence | — |
| Test Example 1 | 15.0 | Absence | Presence |
| Test Example 2 | 12.0 | Absence | Presence |
| Test Example 3 | 14.0 | Absence | Presence |
| Test Example 4 | 18.0 | Absence | Presence |
| Test Example 5 | 10.0 | Absence | Presence |
| Test Example 6 | 11.0 | Absence | Presence |
| Test Example 7 | 10.2 | Absence | Presence |
| Test Example 8 | 10.0 | Absence | Presence |

As shown in Table 2, each of the honeycomb filters according to Examples 1 to 24 had a low value of initial back pressure in a range from 7 to 13.2 kPa, and had no cracks caused by an impact due to a pressure of exhaust gases entering the inside of the through hole, with a back pressure after the endurance test being not so high. Moreover, even after the heat recycling tests, no cracks were observed.

In contrast, each of the honeycomb filters according to Comparative Examples 1 to 8 had a comparatively low initial back pressure in a range from 5 to 10 kPa; however, cracks, which were caused by an impact due to a pressure of exhaust gases entering the inside of the through hole, occurred centered on the wall portion (partition wall) on the exhaust gas outlet side, which had the plug inserted therein, and received the highest impact.

Moreover, in the honeycomb filter according to Comparative Example 4 in which the porosity was lowest and the length of the plug was shortest, the plug came off due to a pressure of exhaust gases.

Furthermore, the honeycomb filters according to text Examples 1 to 8 had a high value in the initial pressure in a range from 10 to 18 kPa, and had no cracks, which were caused by an impact due to a pressure of exhaust gases entering the inside of the through hole observed, observed; however, the back pressure after the endurance test became extremely high, and cracks occurred after the heat cycle tests.

In other words, the honeycomb filters according to Examples 1 to 24 are less likely to cause occurrence of cracks due to an impact from a pressure of exhaust gases discharged from the engine, and superior in the durability, and make it possible to prevent the back pressure from becoming high abruptly upon collecting particulates; therefore, it becomes possible to eliminate the necessity of carrying out the recycling process on the honeycomb filter frequently, and consequently to provide sufficient functions as the filter.

In contrast, each of the honeycomb filters according to Comparative Examples 1 to 8 was more likely to cause: cracks on the wall portion (partition wall) in which the plug is inserted; and coming-off of the plug, resulting in degradation in the durability. Moreover, even in the case of the honeycomb filter having no coming-off of the plug, exhaust gases tend to leak through cracks, failing to sufficiently function as the filter.

Moreover, the honeycomb filters according to Test Examples 1 to 8 are less likely to cause immediate occurrence of cracks due to a pressure of exhaust gases discharged from the engine; however, since the filtering capable region becomes smaller than that of the honeycomb filters according to Examples 1 to 18, the back pressure becomes abruptly higher upon collecting particulates, resulting in cracks during a long-term use.

Here, the results obtained from Examples 19 to 21 as well as Comparative Example 7 show that a honeycomb filter, made of cordierite having a porosity of 55%, has a bending strength of 4.7 MPa, and needs to have a plug having a length of 6.3 mm or more in order to prevent occurrence of cracks during the endurance tests. Moreover, the results of Examples 13 to 15 as well as Comparative Example 5 show that a honeycomb filter, made of cordierite having a porosity of 60%, has a bending strength of 4 MPa, and needs to have a plug having a length of 7.5 mm or more in order to prevent occurrence of cracks during the endurance tests. Furthermore, the results of Examples 22 to 24 as well as Comparative Example 8 show that a honeycomb filter, made of cordierite having a porosity of 70%, has a bending strength of 4 MPa, and needs to have a plug having a length of 10 mm or more in order to prevent occurrence of cracks during the endurance tests.

In the honeycomb filter disclosed in the embodiment of JP Kokai 2003-3823, since the honeycomb filter is made of cordierite, and has a porosity in a range of 55 to 70% in the partition wall, with the length of the plug being set in a range from 2 to 6 mm; the length of the plug is too short, thus it is assumed that cracks tend to occur during the endurance tests.

Figure 8:
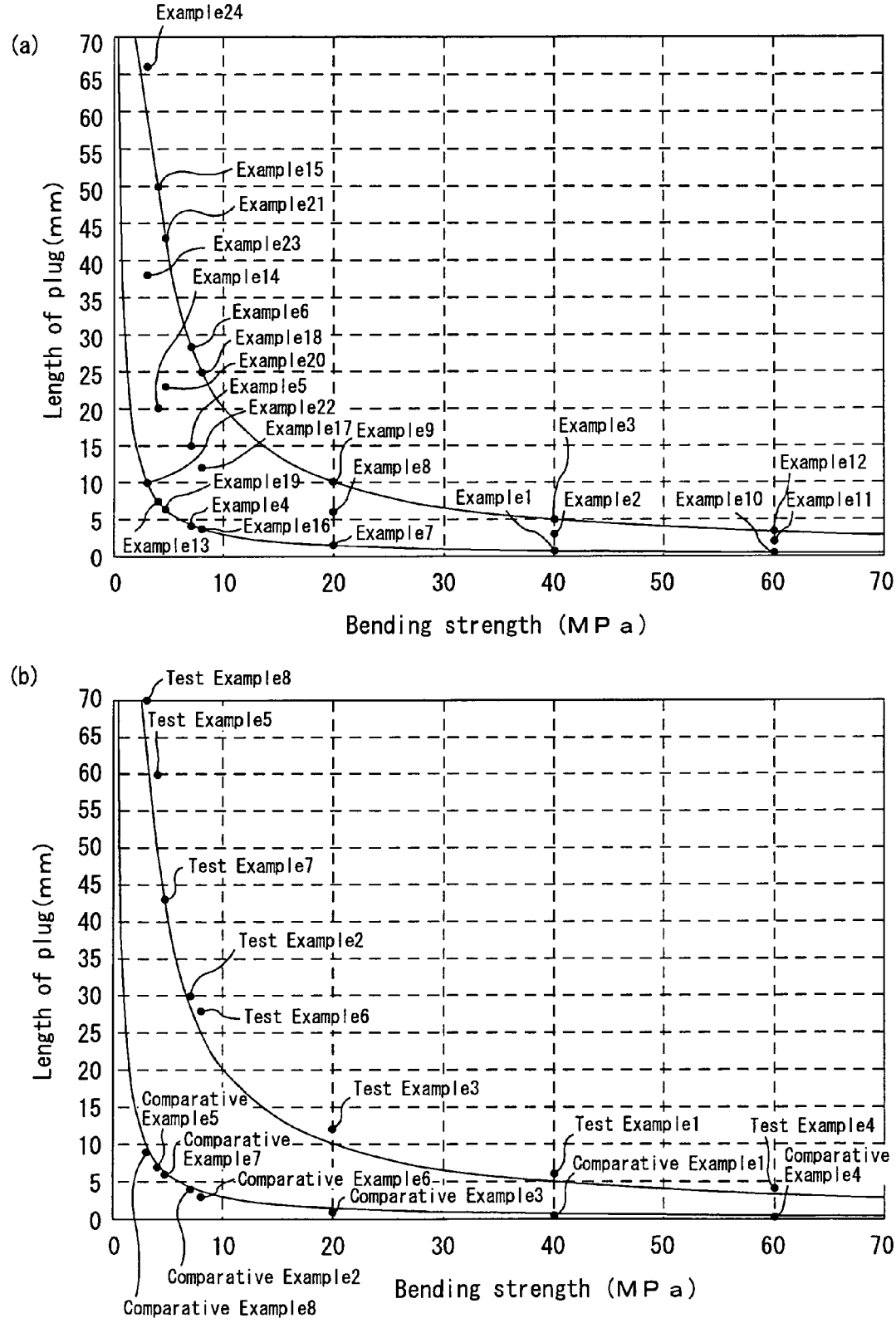
FIG. 8(*a*) is a graph that shows a relationship between the bending strength and the length of the plug of the honeycomb filter according to each example, and FIG. 8(*b*) is a graph that shows a relationship between the bending strength and the length of the plug of the honeycomb filter according to each comparative example and test example.

FIG. 8(*a*) is a graph that shows a relationship between the bending strength of the honeycomb filter and the length of the plug, according to each of Examples 1 to 24; and FIG. 8(*b*) is a graph that shows a relationship between the bending strength of the honeycomb filter and the length of the plug, according to Comparative Examples 1 to 8 as well as Test Examples of 1 to 8. Here, in FIGS. 8(*a*) and 8(*b*), the curve on the lower side represents a curve in which the product of the bending strength Fα of the honeycomb filter and the length L of the plug is set to 30, while the curve on the upper side represents a curve in which the product of the bending strength Fα of the honeycomb filter and the length L of the plug is set to 200.

As shown in FIG. 8(*a*), each of the values of the product between the bending strength Fα of the honeycomb filter and the length L of the plug in Examples 1 to 24 is located between the upper and lower curves, and in contrast, as shown in FIG. 8(*b*), each of the values of the product between the bending strength Fα of the honeycomb filter and the length L of the plug in Comparative Examples 1 to 8 is located below the curve on the lower side. Moreover, each of the values of the product between the bending strength Fα of the honeycomb filter and the length L of the plug in Test Examples 1 to 8 is located above the curve on the upper side.

Based upon the results of the property evaluation tests about the above-mentioned examples and comparative example and the graph shown in FIG. 8, by setting the value of the product between the bending strength Fα of the honeycomb filter and the length L of the plug to a level above the curve on the lower side shown in FIG. 8 (that is, Fα×L is 30 or more), it becomes possible to prevent: occurrence of cracks on the wall portion (partition wall) in which the plug is inserted; and coming-off of the plug due to an impact caused by a pressure of exhaust gases discharged from an engine, and consequently to provide a honeycomb filter that is superior in durability.

Furthermore, based upon the results of the property evaluation tests about the above-mentioned test examples and the graph shown in FIG. 8, by setting the value of the product between the bending strength Fα of the honeycomb filter and the length L of the plug to a level below the curve on the upper side shown in FIG. 8 (that is, Fα×L is 200 or less), it becomes possible to provide a honeycomb filter that has a low initial back pressure, is less likely to cause an abrupt rise in the back pressure upon collecting particulates, and can be used for a long time.

INDUSTRIAL APPLICABILITY

Since the honeycomb filter for purifying exhaust gases according to the present invention has the above-mentioned arrangement, it is free from occurrence of cracks and coming-off of plugs and is superior in durability upon its use.

The invention claimed is:

1. A honeycomb filter for purifying exhaust gases comprising:

a columnar body comprising porous ceramic and having a plurality of through holes extending in parallel with one another in a length direction of the columnar body, the columnar body having a wall portion interposed between the through holes and configured to filter particulates in exhaust gases; and a plurality of plugs filling ones of the through holes at one end of the columnar body and filling ones of the through holes at the other end of the columnar body, wherein the columnar body has a three-point bending strength Fα (MPa) measured in accordance with JISR1601, the plurality of plugs has a length L (mm) in the length direction, and the columnar body and the plurality of plugs are formed such that the three-point bending strength Fα (MPa) and the length L (mm) are adjusted to satisfy the relationship of $F\alpha \times L \geqq 30$.

2. The honeycomb filter for purifying exhaust gases according to claim 1, wherein the three-point bending strength Fα (MPa) and the length L (mm) satisfy the relationship of $30 \leqq F\alpha \times L \leqq 200$.

3. The honeycomb filter for purifying exhaust gases according to claim 2, further comprising a catalyst provided in the columnar body.

4. The honeycomb filter for purifying exhaust gases according to claim 2, wherein the columnar body uses a gas flow to remove the particulates collected and accumulated in the wall portion by a back washing process.

5. The honeycomb filter for purifying exhaust gases according to claim 3, wherein the columnar body uses a gas flow to remove the particulates collected and accumulated in the wall portion by a back washing process.

6. The honeycomb filter for purifying exhaust gases according to claim 2, wherein the columnar body allows heated exhaust gases to flow and removes the particulates collected and accumulated in the wall portion by the heated exhaust gases.

7. The honeycomb filter for purifying exhaust gases according to claim 3, wherein the columnar body allows heated exhaust gases to flow and removes the particulates collected and accumulated in the wall portion by the heated exhaust gases.

8. The honeycomb filter for purifying exhaust gases according to claim 1, wherein the columnar body comprises a plurality of porous ceramic members and an adhesive layer comprising a sealing material and joining the plurality of porous ceramic members.

9. The honeycomb filter for purifying exhaust gases according to claim 8, wherein the three-point bending strength $F\alpha$ (MPa) and the length L (mm) satisfy the relationship of $30 \leqq F\alpha \times L \leqq 200$.

10. The honeycomb filter for purifying exhaust gases according to Claim 8, wherein the plurality of porous ceramic members comprises silicon carbide.

11. The honeycomb filter for purifying exhaust gases according to claim 2, wherein the length L satisfies the relationship of $0.5 \leqq L \leqq 40$.

12. The honeycomb filter for purifying exhaust gases according to claim 2, wherein the three-point bending strength $F\alpha$ satisfies the relationship of $1 \leqq F\alpha \leqq 60$.

13. The honeycomb filter for purifying exhaust gases according to claim 2, wherein a three-point bending strength $F\alpha$ is measured by using a prismatic shaped sample having a cross-sectional extending perpendicular to a length direction of the through holes, the cross-section having a size of approximately 34 mm×34 mm.

* * * * *